US007869910B1

(12) United States Patent
Bandyopadhyay et al.

(10) Patent No.: US 7,869,910 B1
(45) Date of Patent: Jan. 11, 2011

(54) AUTO-CATALYTIC OSCILLATORS FOR LOCOMOTION OF UNDERWATER VEHICLES

(75) Inventors: Promode R. Bandyopadhyay, Middetown, RI (US); Alberico Menozzi, Raleigh, NC (US); Daniel P. Thivierge, Warren, RI (US); David N. Beal, Providence, RI (US); Amuradha Annaswamy, West Newton, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 748 days.

(21) Appl. No.: 11/901,546

(22) Filed: Sep. 14, 2007

(51) Int. Cl.
*G05D 19/00* (2006.01)
*G06F 19/00* (2006.01)

(52) U.S. Cl. ..... 701/21; 440/13

(58) Field of Classification Search ..... None
See application file for complete search history.

(56) References Cited

U.S. PATENT DOCUMENTS 5,401,196 A * 3/1995 Triantafyllou et al. ..... 440/13
6,877,692 B2 * 4/2005 Liu ..... 244/22

OTHER PUBLICATIONS

Schouveiler et al.; Performance of flapping foil propulsion; Journel of Fluids and Structures 20 (2005), p. 949-959.*

V.B. Kazantsev, V.I. Nekorkin, V.I. Makarenko, R. Llinas, Self-Referential Phase Reset Based on Inferior Olive Oscillator Dynamic, article, Dec. 28, 2004, p. 18183-18188, vol. 101, No. 52, PNAS, Russia.

G. McCollum, A. Pellionisz, R. Llinas, Tessorial Approach to Color Vision, article, 1982, p. 23-28, Australian Scientific Press, Australia.

Manuel G. Velarde, Vladimir I. Kekorkin, Viktor B. Kazantsev, Vladimir I. Makarenko, Rodolfo Llinas, Modeling Inferior Olive Neuron Dynamics, article, 2001, p. 5-10, Elsevier Science Ltd, Spain.

V.B. Kazantsev, V.I. Nekorkin, V.I. Makarenko, R. Llinas, Olivo-Cerebellar Cluster-Based Universal Control System, article, Oct. 28, 2003, p. 13064-13068, vol. 100, No. 22, PNAS, Russia.

* cited by examiner

*Primary Examiner*—Michael J. Zanelli
(74) *Attorney, Agent, or Firm*—James M. Kasischke; Michael P. Stanley; Jean-Paul A. Nasser

(57) ABSTRACT

A system is provided to control maneuvering flapping foils of an underwater vehicle. An oscillator generates periodic signals in which effects of external disturbances are minimized or amplified as required; the periodic signal can be either sinusoidal or can depart significantly from a sinusoid; the amplitude and frequency are varied by changing the oscillator parameters and the phase between the signals are varied by changing the parameters. The oscillator restores the parameters after a disturbance. Since the oscillator functions without external sensors, the oscillator serves as an inner-loop controller with a centralized control. An open loop control architecture for the controller, results in a motion where the vehicle maneuvers execute as force and moment commands. The non-linear, auto-catalytic oscillator can be realized using a variety of second-order differential equations. An oscillator model is added to a conventional motor control, where the outputs of the oscillator control the foils in real-time.

11 Claims, 42 Drawing Sheets

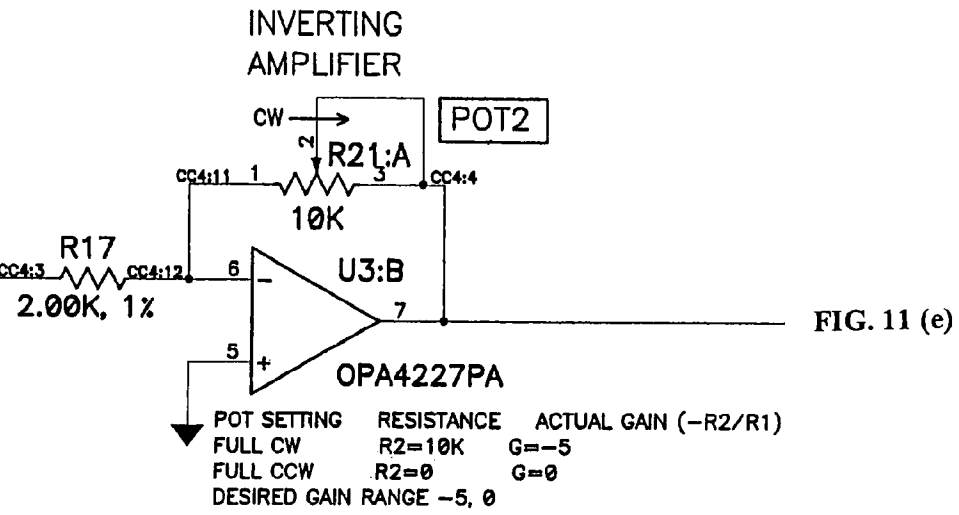
FIG. 11 (e)
FIG. 11 (a)
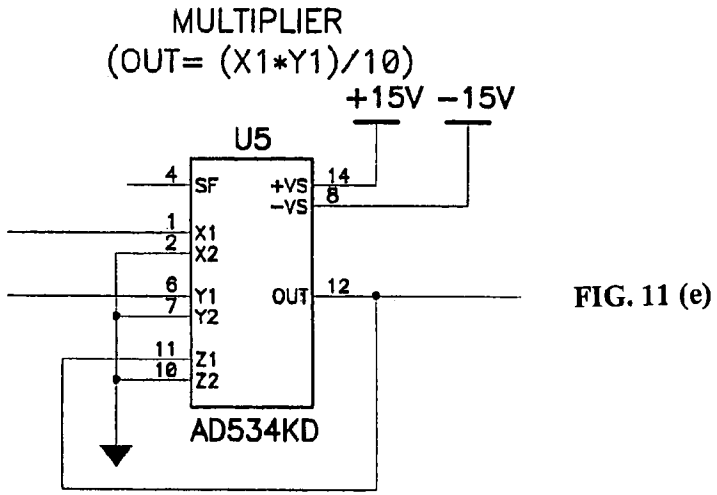
FIG. 11 (e)
FIG. 11 (a)
FIG. 11 (b)

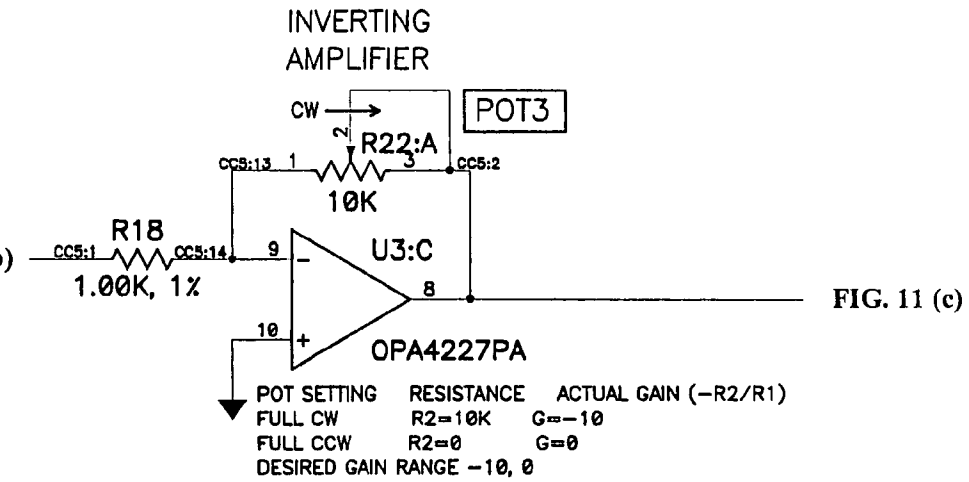
FIG. 11 (b)
FIG. 11 (c)
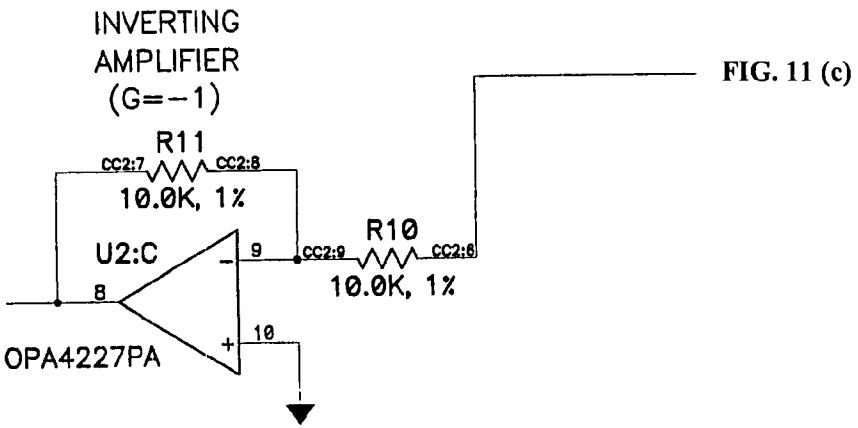
FIG. 11 (d)
FIG. 11 (e)

AUTO-CATALYTIC OSCILLATORS FOR LOCOMOTION OF UNDERWATER VEHICLES

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED APPLICATIONS

This application relates to U.S. patent application Ser. No. 12/021,555, filed on 29 Jan. 2008 and which is entitled OLIVO-CEREBELLAR CONTROLLER by the inventors Promode R. Bandopadhyay, Alberico Menozzi, Daniel P. Thivierge, David N. Beal and Anuradha Annaswamy.

BACKGROUND OF THE INVENTION (1) Field of the Invention

The present invention relates to a control system for a flapping foil maneuvering device used on an underwater vehicle in which there is a plurality of the flapping foil devices positioned on the vehicle. The motion of the flapping foils is enabled by using non-linear auto-catalytic oscillators.

(2) Description of the Prior Art

A comparison of underwater vehicles and swimming animals, in the context of cruising and maneuvering, illustrates a divergence in their performance. While underwater vehicles outperform their biological counterparts when it comes to cruising, maneuvering (especially at low-speeds) is achieved more efficiently by swimming animals.

The maneuverability of swimming animals is facilitated by the use of foils extending from the body of the animal in which the foil-type appendages flap almost continuously. From this basic configuration, animal-like agility and flexible use of different swim modes are possible for the vehicle by selection of the type, number, and location of the foils.

Swimming animals accomplish low-speed maneuverability by unsteady actuation of the foils. The unsteady actuation of the foils allows the generation of high lift at the foils via dynamic stall and torque production (even at low and zero forward speeds), which leads to efficiency and high maneuverability. A relatively high lift coefficient can be achieved by using unsteady hydrodynamics as compared to using steady hydrodynamics.

Swimming animals are also more capable of maneuvering with a small turn radius although the gap between animals and man-made devices in maneuvering has narrowed due to improvements in digital controllers. In a further effort to narrow or bridge this gap, high-lift principles observed in swimming and flying animals have been implemented in an underwater vehicle. As a result, the underwater vehicle has three animal-like features; the first feature is low speed maneuverability, the second feature is low noise production and the third feature is high efficiency in the form of low power consumption.

The value of neuroscience-based control of the underwater vehicle is evident when non-linear auto-catalytic properties of oscillators are used to introduce local autonomy; thereby, providing the underwater vehicle with a natural robust property (without relying on sensors) when responding to unforeseen disturbances and obstructions. Similar to the non-linear mechanisms that an Inferior-Olive system uses to produce a robust balancing motion in animals, non-linear oscillators flap the propulsive foils of the underwater vehicle to produce a robust and balanced locomotion of the underwater vehicle.

More specifically and relevant to the disclosure that follows, an underwater vehicle developed by the United States Navy has multiple flapping foils positioned on an exterior of the vehicle. Each of the flapping foils can independently execute a pitching and rolling motion. The flapping foils also have multiple degrees of freedom that can input periodic 3-D forces and moments, whose amplitude, frequency, phase and relative bias can be independently controlled. Data gathered from the undersea vehicle indicates that with high-lift actuators and appropriate controllers, it is possible to achieve a maneuvering optimization that is similar to animals and even superior to the maneuverability of animals.

The motion of the flapping foils allows the generation of high lift via dynamic stall and torque production, which leads to efficiency and high maneuverability. A continuous and controlled flapping motion of these foils has been documented to produce the necessary lift and thrust and the ability to produce various maneuvers of the undersea vehicle at different speeds.

With the appropriate actuation that can deliver the requisite mobility, a critical area of support for actuation is the calculation and processing of an efficient swimming algorithm. The first requirement of actuation is the property of robustness, which is the ability to deliver a periodic motion in the presence of environmental and system disturbances. The second requirement of actuation is that the controls occur with local autonomy by preferably a sensor-less configuration.

A method for generating such periodic motion with sensor-less autonomy and robustness is by using a non-linear system that is capable of producing self-excited oscillations and having the ability to maintain an oscillatory mode despite perturbations. While a periodic motion such as a sinusoid can be derived using linear circuits, the robustness property is not inherently present and can be incorporated only by using sensor-based feedback and suitable compensation to the feedback.

Non-linear actuators do exist in nature and are ubiquitous in living organisms. For example, circadian rhythms, cardiac rhythms, hormonal cycles, rhythms of breathing and swimming, the stable orbits of astronomical bodies, are all produced in nature. Periodic oscillations of a specified magnitude and that are frequency-synthesized using non-linear differential equations are referred to as limit cycles. The limit cycle properties of non-linear oscillators have been observed to be present in many branches of natural science including biology.

Unlike linear systems that exhibit sustained oscillations whose amplitude is proportional to the magnitude of the disturbances that the systems are subjected to, limit cycles have the ability to maintain a prescribed profile of oscillations and the ability to return to the prescribed profile even when disturbed and once a disturbance is removed. It could therefore be argued that instances of sustained oscillations observed in nature are necessarily produced by such limit cycles, that the oscillations are non-linear and are auto-catalytic. This self-organizing nature is perhaps the reason that biological phenomena provide a baseline for generating rhythmic patterns. Such exemplified structural stability makes a limit cycle a reasonable option for engineering design.

It is also known in biology that central pattern generators abound in a central nervous system and are routinely used for synchronizing the motor actions of limbs during locomotion. In the context of locomotion, proper execution of active movements in animals appears to occur as a function of the olivo-cerebellar system of the brain. An olivo-cerebellar system is an autonomous system of neurons that can generate a rhythmic pattern of neuronal discharge that can ultimately coordinate muscles in a manner similar to that seen during normal locomotion. This concept in general, and the specific fact that non-linear oscillators are adept at producing robust periodic orbits have been studied extensively in the context of walking by humans and robots.

The utilization of non-linear oscillators by the inferior olive system provides an inherent robustness to the generation of synchronized signals thereby providing signals to the appropriate motor neurons and therefore providing an operating robustness to the intended movement.

As a result, an opportunity exists to use nature-like features of maneuvering by utilization of auto-catalytic non-linear oscillators to drive the flapping foils of an underwater vehicle so as to achieve an operating robustness.

SUMMARY OF THE INVENTION

Accordingly, it is a general purpose and primary object of the present invention to provide circuitry that controls an auto-catalytic non-linear oscillator integrated with the maneuvering system of a multi-foil biorobotic underwater vehicle.

It is a further purpose of the present invention to provide circuitry that controls an auto-catalytic non-linear oscillator which allows robust operation and autonomous movement by the underwater vehicle.

In order to attain the objects described, the present invention provides a control system for a non-linear oscillator to directly drive the flapping foils of an underwater vehicle. The main features of the non-linear oscillator are: the non-linear oscillator generates at least two unique periodic signals; the periodic signals are stable in that any disturbances introduced are automatically minimized as required or amplified as required; the amplitude and frequency of the periodic signal can be varied by changing the parameters of the oscillator; the phase between the two signals can be varied by changing the parameters of the oscillator; and the periodic signal can be either sinusoidal or can depart significantly from a sinusoid. Since the non-linear oscillator functions at a local level without requiring external sensors and fast time scales, or the involvement of the main controller, the oscillator serves as an inner-loop controller. This centralized architecture supports the autonomous undersea vehicle in which the vehicle is capable of swimming like an animal, overcoming perturbations and obstacles, and carrying out efficient and intelligent locomotion.

The construction of the underwater vehicle for illustrating the present invention is a cylindrical hull that is closed at each end by endplates. Each of the endplates serves as a mounting fixture for flapping foil assemblies. Underwater movement similar to swimming is accomplished by the coordination of forces and moments produced by the flapping foils assemblies. The flapping foil assemblies are articulated via an organized oscillatory motion that is synthesized by a control computer in response to user-issued commands. The control involving an algorithm, which can be referred to as open loop control architecture for the control computer, results in a vehicle motion executed in the form of force and moment commands.

With or without a stimulus, the underlying non-linear system is capable of producing a limit-cycle with the nature of the periodic signal altered by the nature of the external stimulus. Whether second or higher-order and whether external stimulus is present or not, it is possible to generate sustained impulse trains or other periodic oscillations using a group of non-linear oscillators.

The oscillator is constructed using operational amplifiers and precision multipliers. The former is used to perform the action of an integrator (when a capacitance is connected across the op-amp) and an inverter (when a resistance is connected across the op-amp). Since the oscillator is second-order, there are at least two integrators and there are at least eight inverters that perform multiplication by suitable constants to simulate the linear components of the oscillator. The multipliers allow the generation of the cubic non-linearity in the oscillator.

Servomotors control the foil motion and sensors measure the torque outputs from the pitch and roll motor shafts. All of the above forces and moments, the voltage and current into the motor amplifiers, and the motor encoder positions, are recorded. An oscillator is added to a conventional motor control model, where the outputs of the oscillator drive the positions of the flapping foil in real-time.

BRIEF DESCRIPTION OF THE DRAWINGS

Further objects and advantages of the invention will become readily apparent from the following detailed description and claims in conjunction with the accompanying drawings, wherein:

DETAILED DESCRIPTION OF THE INVENTION

The integration of biology and engineering has proceeded by coding intended movement via non-linear oscillators that produce several synchronized neuronal outputs in an inferior olive cluster, which in turn produces a motor activation pattern that proceeds to actual motion.

A hybrid approach is described in the present invention, which is to adopt the biologically-inspired architecture of non-linear oscillators by using a response to directly drive the flapping foils of an underwater vehicle. Such a hybrid approach retains a functional similarity to the robust balancing action of the inferior olive system. The robustness feature is retained through the non-linearity in the oscillators, while the balancing feature is produced by the phase-coordination of flapping foil assemblies of an underwater vehicle.

Figure 1:
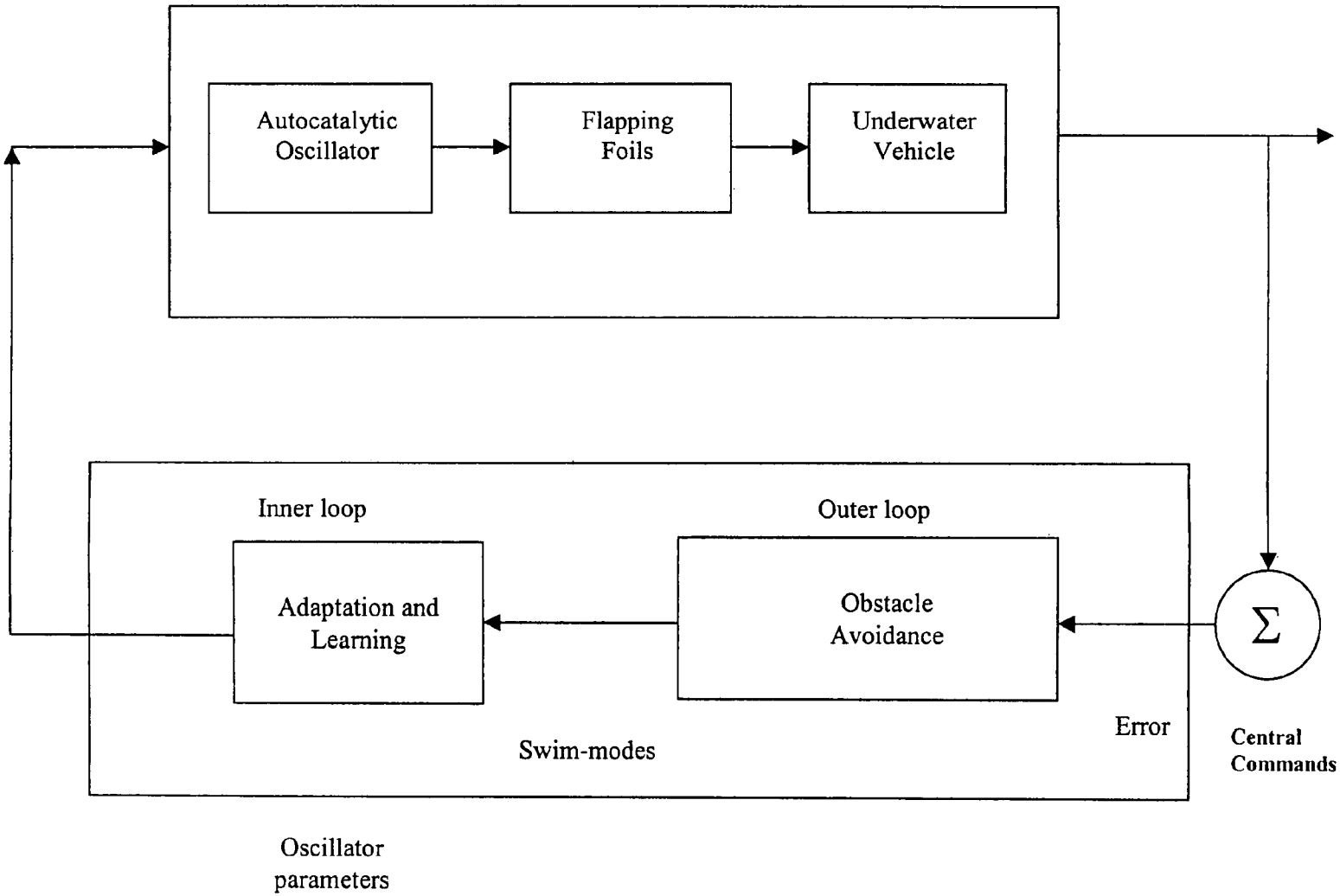
FIG. 1 depicts a schematic block diagram of the controller of an undersea vehicle locomotion using an auto-catalytic oscillator.

A more complete understanding of the invention and many of the attendant advantages thereto will be readily appreciated as the same becomes better understood by reference to the following when considered in conjunction with the accompanying drawings wherein like reference numerals and symbols designate identical or corresponding parts throughout the several views and wherein FIG. 1 depicts a schematic of an underwater vehicle locomotion controller using an auto-catalytic oscillator to coordinate movement and locomotion of the vehicle.

In the figure, the auto-catalytic oscillator produces a robust periodic signal by making direct use of non-linearity. This periodic signal controls a servomotor and an actuator (not shown). The actuator consequently drives the flapping foils to drive the underwater vehicle. The mechanical motion of the foils is controlled by a "learning loop" system which employs operating parameters such as central commands, obstacle avoidance and adaption/learning to influence the auto-catalytic oscillator parameters.

Figure 2:
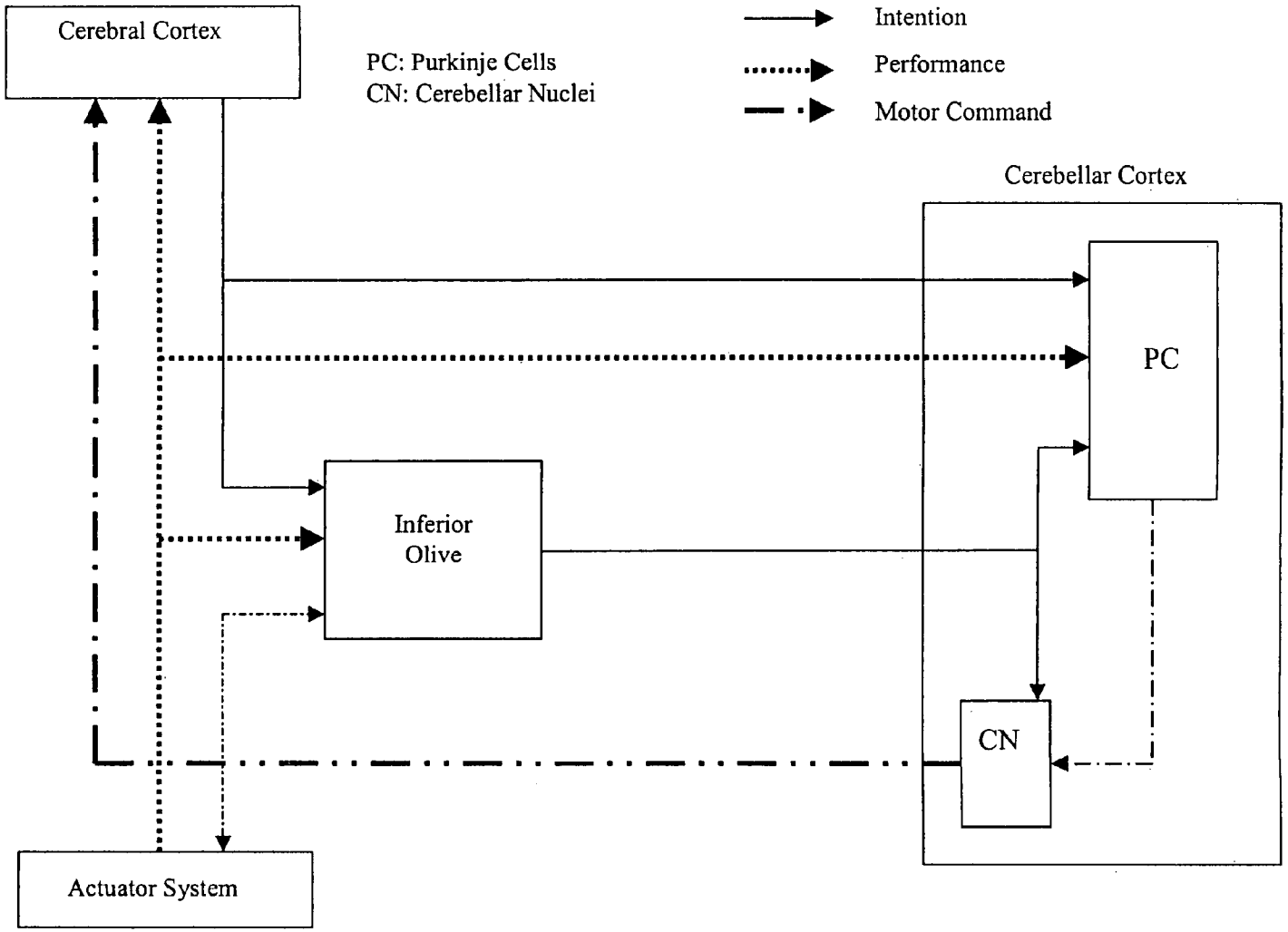
FIG. 2 depicts a block diagram of signal pathways involved in motor control with an olivo-cerebellar system as the hub of motor control activity.

A parallel to vehicle locomotion using non-linear oscillators can be drawn from a neuroscience based system such as an olivo-cerebellar system, which includes an inferior olive and a cerebral cortex. In FIG. 2, the inferior olive of the olivo-cerebellar system is a participant element that is relatively small in size, but essential in function. The inferior olive is instrumental in motor control and learning, and serves as a correction factor in the feedback loop between a central nervous system and muscles.

The inferior olive has rhythmic time-setting properties and exhibits spatio-temporal patterns that are directly related to movement execution. The time-setting property has been shown to be due to coupled non-linear oscillators, and that the inferior olive cell-potential exhibits an independent and self-excited sub-threshold oscillation at approximately 10 Hz. These oscillations are synchronized (i.e., phase-locked) through an electronic coupling cerebellar nuclei or reset to a specific phase via an external stimuli. A synchronized inferior olive neuron cluster corresponds to a specific motor activation pattern, which is used to drive corresponding motor control neurons. The functionality of the inferior olive is organized in clusters of synchronously oscillating neurons that can generate rhythmic and coherent activity in the cerebellum; thereby, playing a central role in motor coordination.

Figure 3:
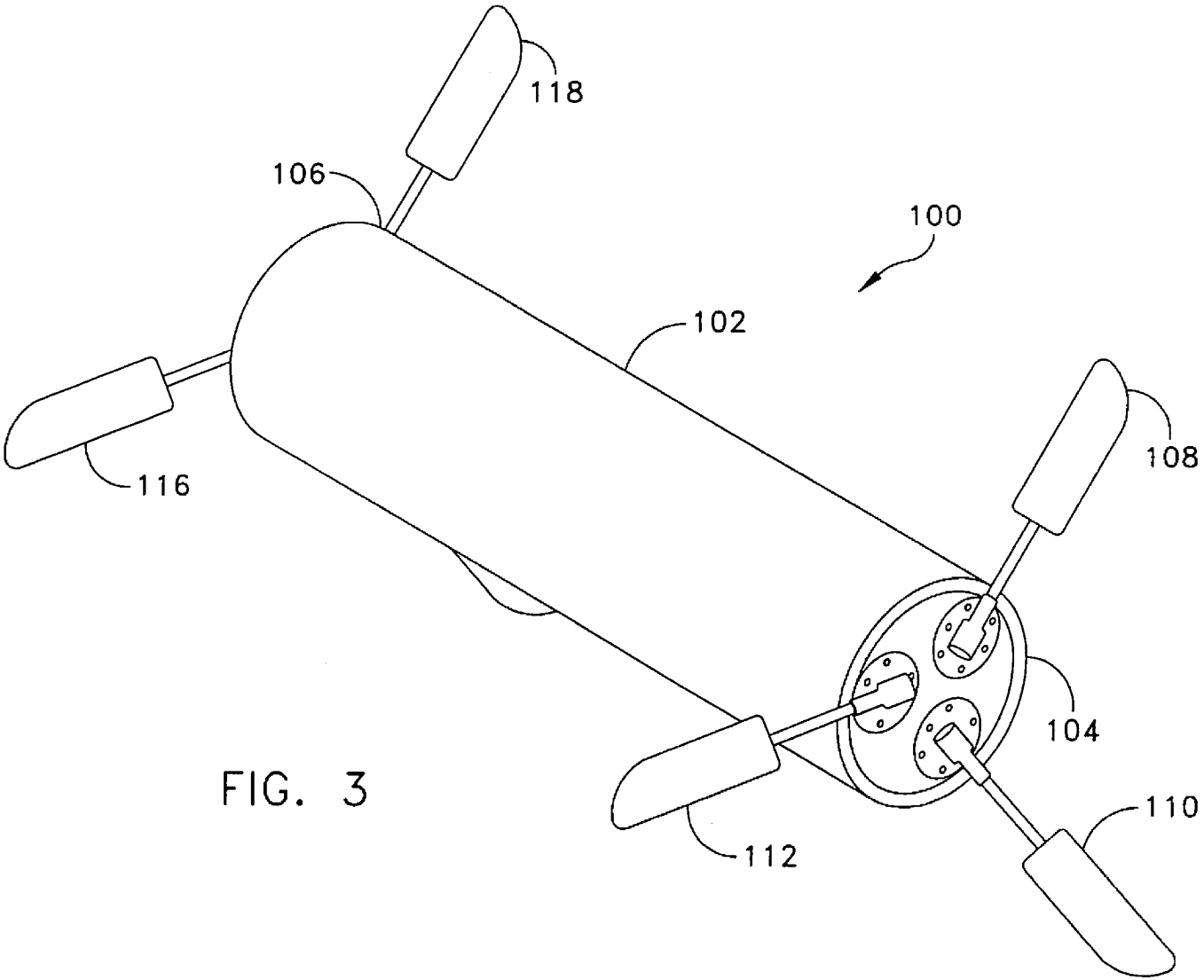
FIG. 3 depicts an underwater vehicle with a multiplicity of flapping foil assemblies.
Figure 4A:
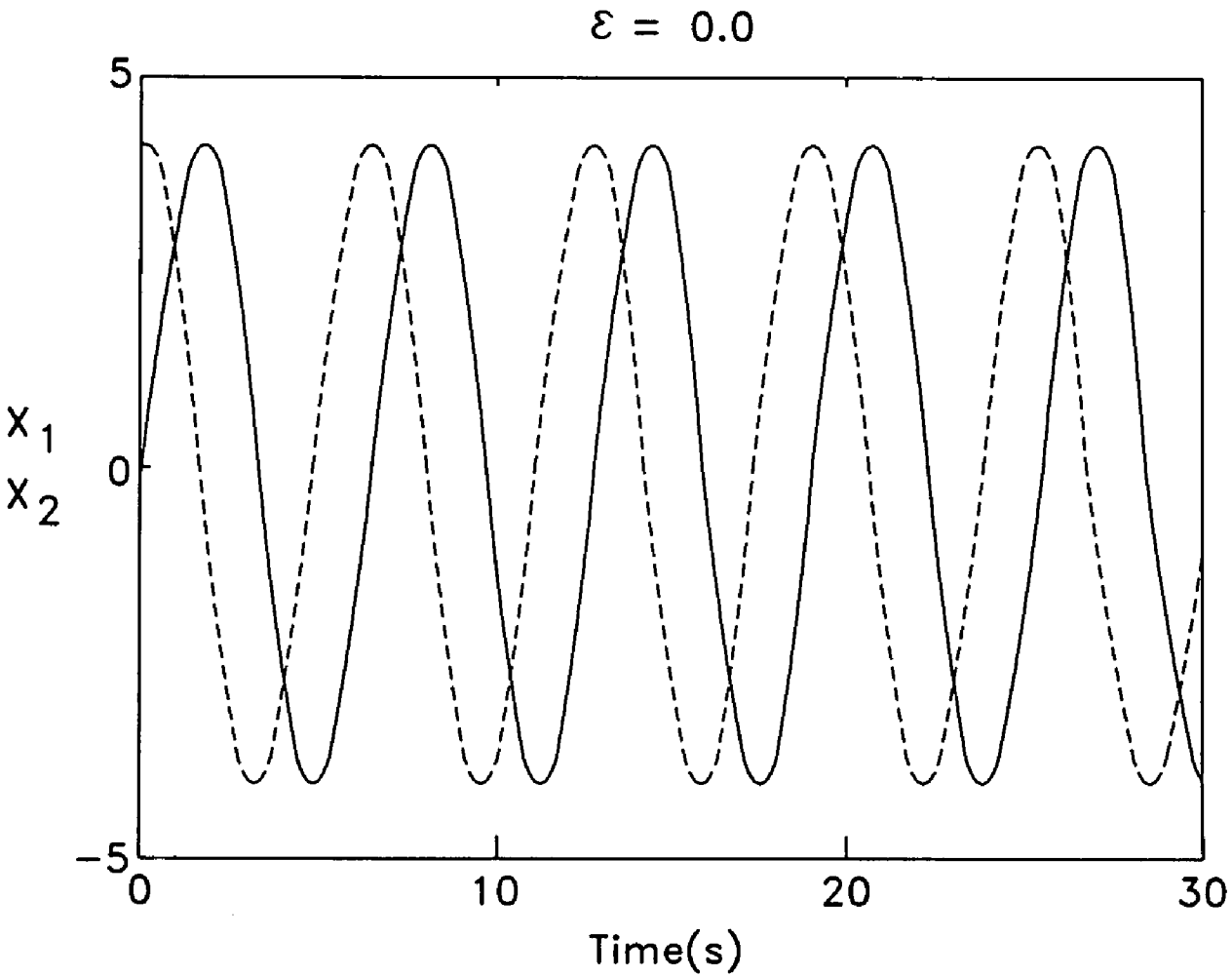
FIG. 4 (*a*)-(*d*) depicts periodic waveforms of $x_1$ and $x_2$ using a Van der Pol oscillator for four epsilon values with increasing departure from sinusoidal waveforms.
Figure 4B:
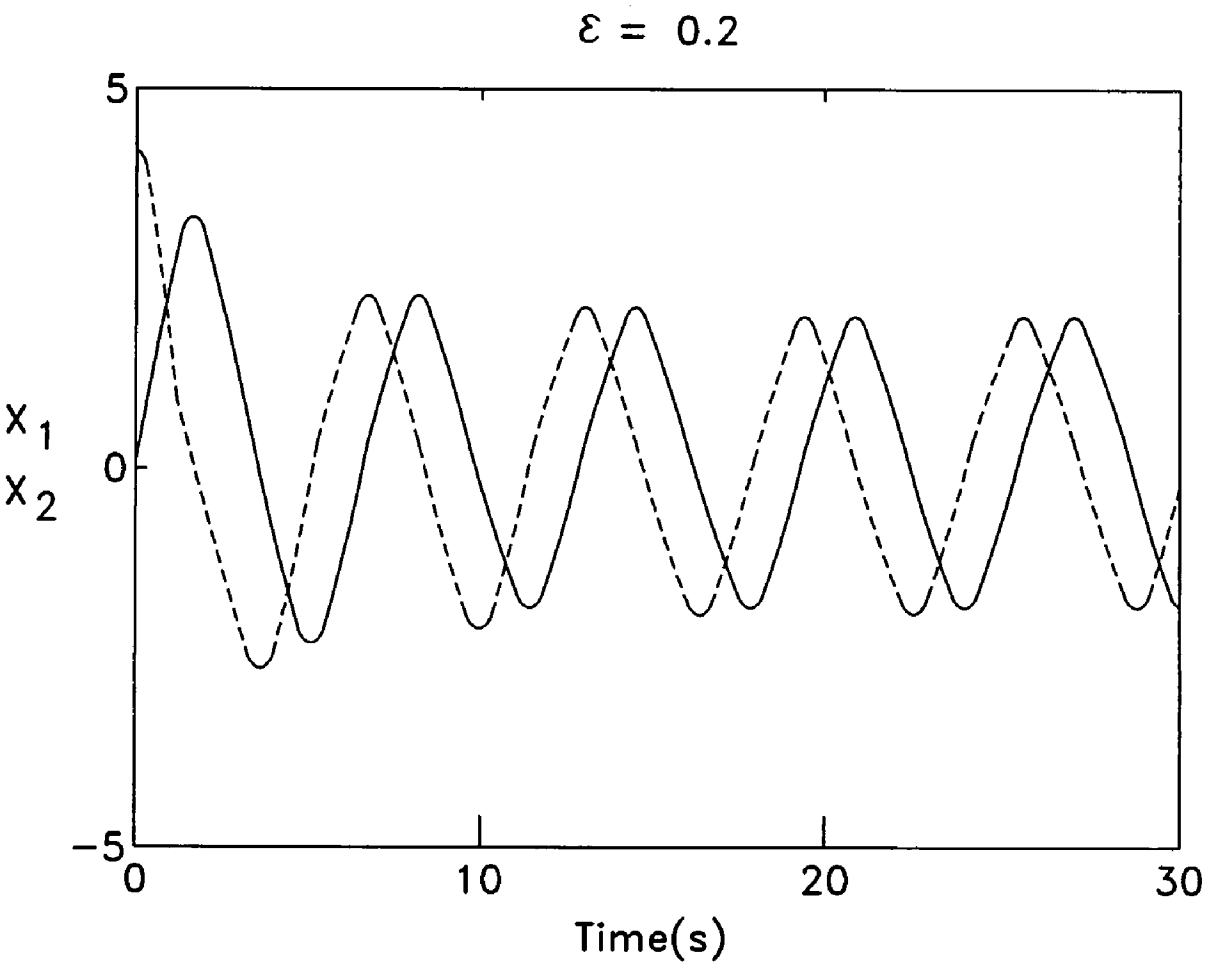
Figure 4C:
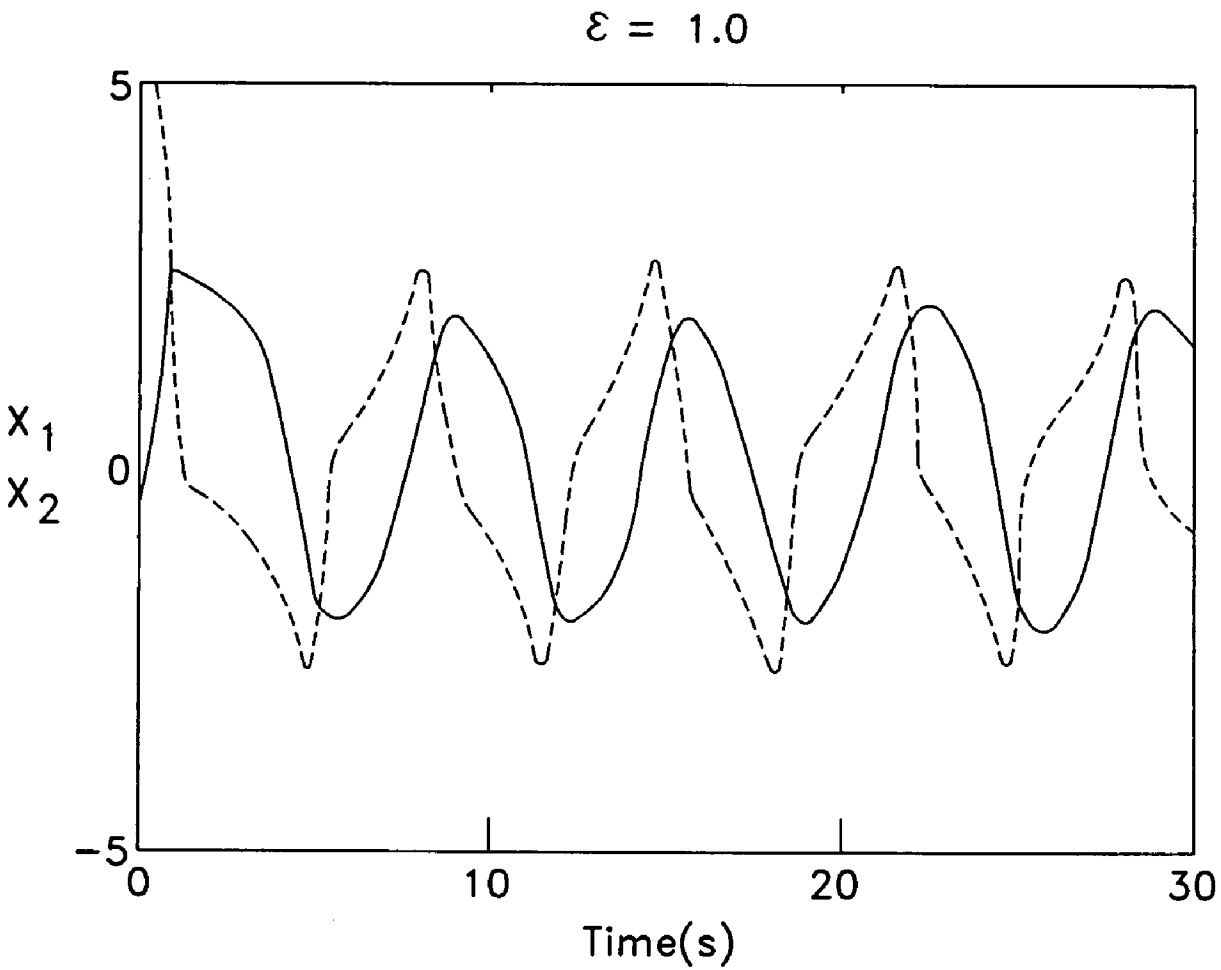
Figure 4D:
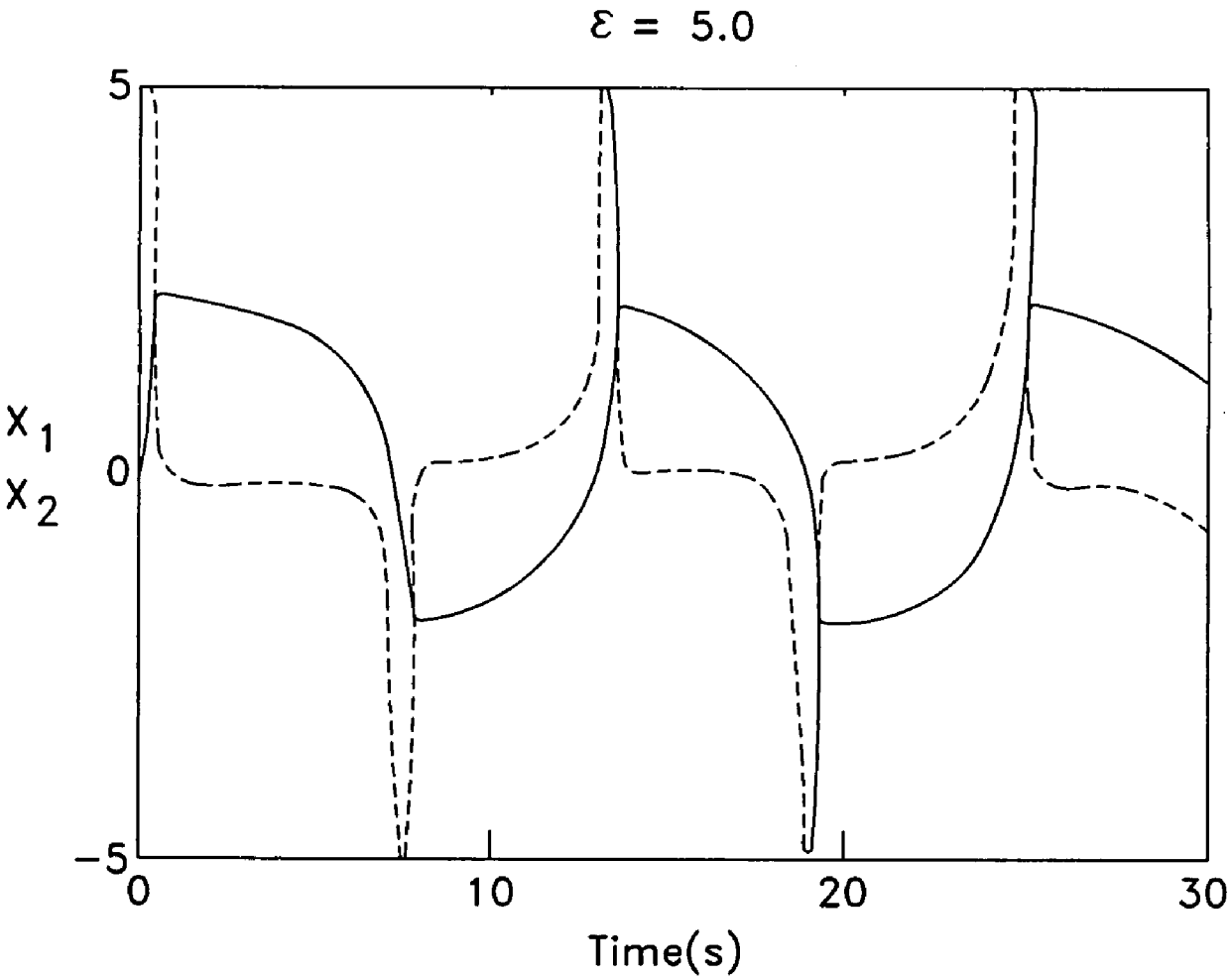
Figure 5A:
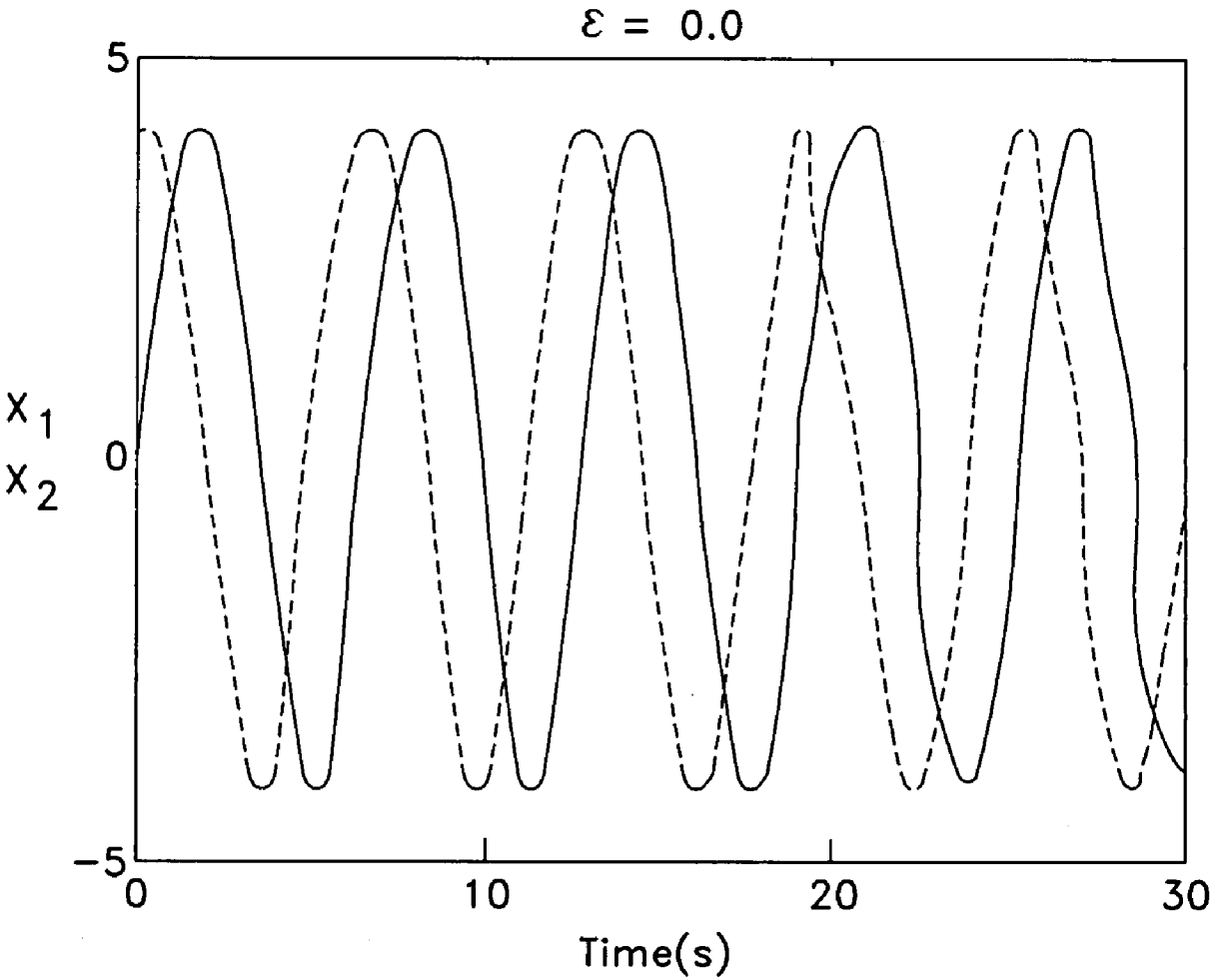
FIG. 5 (*a*)-(*d*) depicts phase state waveforms in relation to a Rayleigh equation with many effects of epsilon.
Figure 5B:
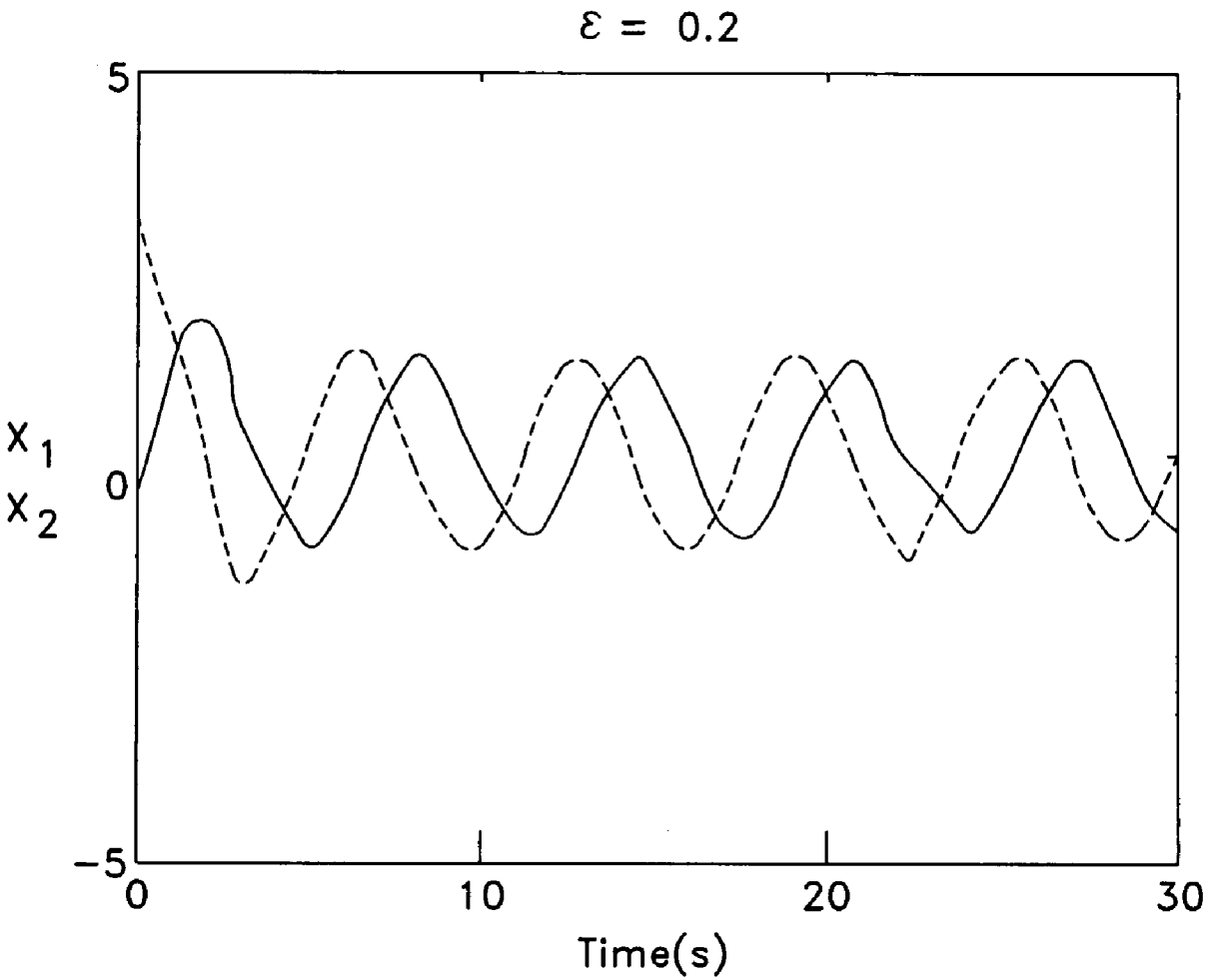
Figure 5C:
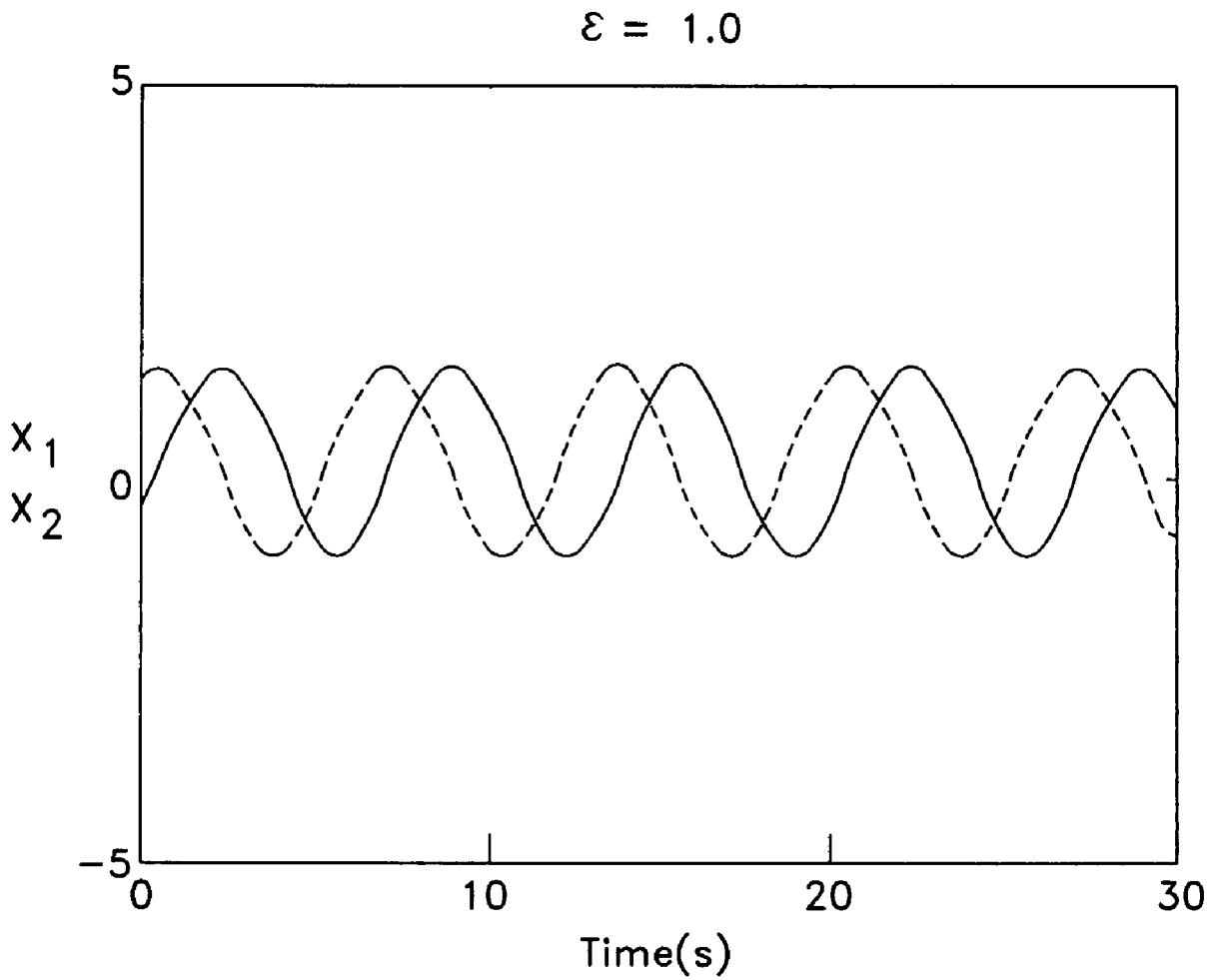
Figure 5D:
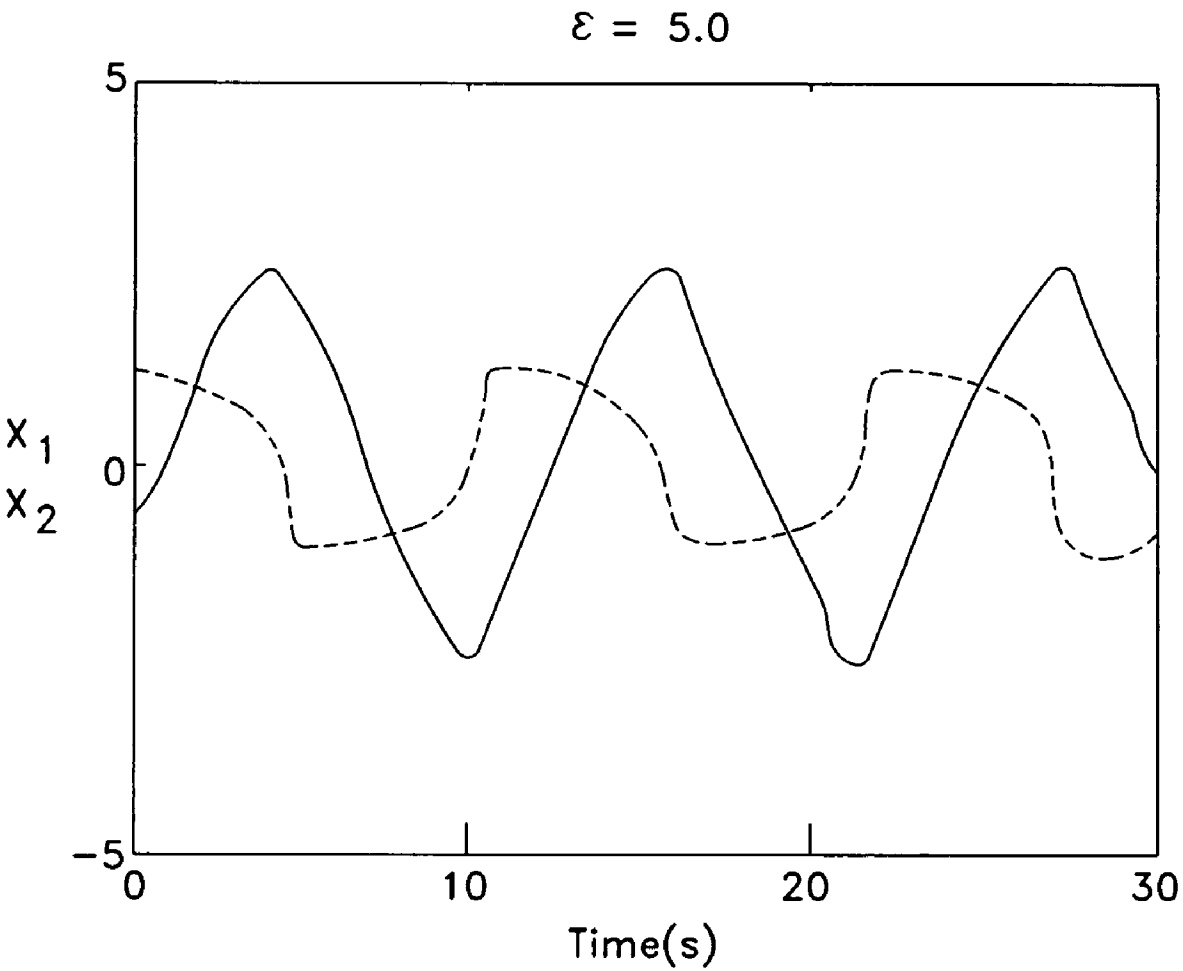

An underwater vehicle 100 that is utilized with the present invention is shown in FIG. 3. The underwater vehicle 100 generally includes a cylindrical hull 102 that is closed at each end by endplates 104 and 106. Each of the endplates 104 and 106 serves as a mounting fixture for flapping foil assemblies 108 through 118. Each flapping foil assembly preferably includes two coupled servomotors and mounted on the dry side of the endplate, connected to a shaft by gears (not shown). This mechanical arrangement allows each foil of the flapping foil assemblies 108 through 118 to move in a pitching and heaving fashion.

The internal components of the underwater vehicle 100, which are not shown but would be recognizable to those skilled in the art, include an energy and power distribution subsystem, a control computer, and a sensor suite. The sensor suite preferably includes a vertical gyro that provides linear accelerations and angular rates, a three-axis tilt compensated digital compass and a pressure sensor. The sensor suite allows an estimation of the variables needed for controlled maneuvering.

The flapping foil assemblies 108 through 118 are articulated via an oscillatory motion that is synthesized by the control computer in response to user-issued commands. The motion of flapping foils is synthesized by sinusoidal motion and uses experimental data of forces and moments generated by a single foil to determine various flapping foil parameters.

For instance, using the geometry of the underwater vehicle 100 and each of the flapping foil assemblies 108 through 118 and an averaged analysis given a desired net force and moment, the required frequency and pitch bias can be calculated. The algorithm for this calculation, is referred to as an open-loop control architecture. In this procedure, a prescribed sinusoidal motion is generated using a linear circuit, whose parameters are pre-calculated using the desired forces and moments.

As previously stated, the purpose of the present invention is to generate sustained periodic motion that can efficiently minimize external disturbances. The field of dynamic systems provides tools to realize this purpose. Dynamic systems theory explains the generation of a variety of temporal profiles via ordinary linear and non-linear differential equations. The relevant results from this field are summarized below by starting with an ordinary linear differential equation:

$$\ddot{x}+2\zeta\omega\dot{x}+\omega^2x=0, \tag{1}$$

where "ω" represents the frequency of oscillations $\dot{x}$ is the first derivative, $\ddot{x}$ is the second derivative and "ζ" is a damping parameter.

That is, the solutions of Equation (1) exhibit a stable convergent behavior if $\zeta>0$, a divergent behavior if $\zeta<0$ and an oscillatory behavior if $\zeta=0$. Since Equation (1) is linear, all of the behavior is scaled proportionate to the initial conditions. This implies that a perturbation in the initial condition is transmitted, without any attenuation, directly to the amplitude of the resulting dynamics in a proportionate manner. Consider the case when $\zeta=\zeta_0$ with $0<|\zeta_0|<1$, note that the linear system in Equation (1) responds with an exponentially divergent sinusoid.

A non-linear auto-catalytic oscillator is generated by modifying Equation (1) into a non-linear system:

$$\ddot{x}+f(x)\dot{x}+\omega^2x=0\ f(x)=\alpha_0x^2-2\zeta_0\omega,\ \alpha_0,\zeta_0>0. \quad (2)$$

A qualitative analysis of Equation (2) can be carried out in the following manner. Note that the non-linearity f approximates the negative constant $-2\zeta_0\omega$ for small values of x and as x becomes large, f becomes positive. As a result, beginning with small initial conditions in x, since $f\approx-2\zeta_0\omega$, then the tendency of the solutions is to grow.

As x becomes large, since f becomes positive, it can be viewed as a system with positive damping, causing the magnitude of the solution to decrease once again. As x becomes small, again the linear term in f dominates, causing yet another divergent response, and the alternating convergent-divergent process repeats.

This phenomenon leads to a periodic, sustained, set of oscillations, which is essentially a non-linear phenomenon, where all solutions of the non-liner system, in the limit, converge to the periodic cycle. The solution is referred to as a limit cycle and the specific oscillator shown in Equation (2) is a Van der Pol oscillator. When this system is perturbed due to any external influences, the system automatically introduces corrective actions by way of non-linear components of the system, causing the system to maintain the oscillations, thus exhibiting an auto-catalytic characteristic. Note that the actual size and shape of the limit cycle is a function of the parameters $\theta=(\alpha_0,\zeta_0,\omega)$. As θ varies, the limit cycle varies as well. In particular, the magnitude, frequency, and phase characteristics change as θ varies.

The above discussions also show that one can realize a non-linear auto-catalytic oscillator using a variety of second-order differential equations of the form of:

$$\ddot{x}+f(x,\dot{x})\dot{x}+g(x)=0 \quad (3)$$

where $f(x,\dot{x})$ and g(x) are such that the non-linear system in Equation (3) alternates between a convergent and a divergent behavior leading to a sustained periodic solution, or in other words, a stable limit cycle. Some examples of this behavior are listed in Table 1.

TABLE 1

Examples of Stable Limit Cycles

| $f(x, \dot{x})$ | g(x) | Type of equation | Bio-example |
|---|---|---|---|
| Monotonic f(x), with f (x) = f(−x) | g(x), x g (x) > 0, x ≠ 0 | FIG. 4 (a)-(d) one example of the Lienard equation- family | Axon membrane potential |
| $\epsilon(x^2-1)$ | x | Van der Pol's equation | Beating of the Heart |
| $\epsilon(\dot{x}^2-1)$ | x | Rayleigh's equation FIG. 5 (a)-(d) | Inferior Olive |
| $\frac{F\,\mathrm{sgn}(\dot{x})}{(\dot{x})}-2\varsigma\omega$ | $\omega^2x$ | Coulomb friction model | Ventricular flow |
| $F\,\mathrm{sat}(\dot{x})$ | $\omega^2x$ | General friction model | |
| $\dot{x}+a_0\dot{x}+a_1$ | $\omega^2x$ | Inferior Olive subsystem | |

As shown in FIG. 4 (*a*)-(*d*), when ϵ=0, the Van der Pol oscillator reduces to a linear oscillator, and produces sinusoidal waveforms whose amplitude depends on the initial conditions. For values of ϵ>o, the Van der Pol oscillator realizes periodic waveforms whose amplitude is independent of initial conditions and whose shape is retained in spite of perturbations. Utilizing these signals to drive the motion of a flapping foil, for example, results in a robust and consistent swim stroke. The ϵ parameter can be used in hardware implementations to change the waveform shape; therefore, changing the shape of the swim stroke (perhaps to adaptively optimize thrust efficiency). If a radically different swim stroke shape is desired, it may be realizable with other non-linear oscillator equations (such as Rayleigh's equation).

When ϵ=o, the Van der Pol oscillator reduces to a linear oscillator, which has a continuum of closed orbits. For values of ϵ>o, the Van der Pol oscillator becomes a non-linear oscillator with one isolated periodic orbit (i.e., a limit cycle). This closed orbit attracts all trajectories starting off the orbit, making the oscillator structurally stable (i.e., the oscillation is resistant to perturbations), and ensuring that the amplitude of oscillation at a steady-state is independent of initial conditions. These qualities are fundamentally important to biological systems that rely on periodic signals to support or realize vital functions (e.g., heartbeat, locomotion gait, neural activity).

Varying the value of ϵ and/or adding a bias term can yield a desired shape of the orbit and of the corresponding time-domain periodic signals. For small values of ϵ, the closed orbit is smooth and approximates a circle of radius two. Medium values of ϵ result in a moderately distorted closed orbit. For large values of ϵ, the closed orbit is severely distorted. The ϵ parameter can be used in hardware implementations to achieve a specific signal shape out of the available choices. Signal shapes that are not realizable with the equation may be realizable with other non-linear oscillator equations (such as Rayleigh's equation).

As shown in FIG. 5 (*a*)-(*d*), when ϵ=0, the Rayleigh equation reduces to a linear oscillator, just like in the Van der Pol scenario. For values of ϵ>o, the Rayleigh equation realizes periodic waveforms that are fairly sinusoidal, becoming markedly different only for large values of ϵ. Some waveform shapes that are realizable with the Van der Pol oscillator are not realizable with the Rayleigh equation and vice versa. For example, the Rayleigh equation can be utilized to easily achieve a saw tooth waveform, while the Van der Pol oscillator cannot.

When ϵ=o, the Rayleigh equation also reduces to a linear oscillator since the crucial non-linearity is eliminated. For values of ϵ>o, the Rayleigh equation yields a limit cycle. The set of shapes that are realizable by varying the parameter (epsilon; eps) is different from that of the Van der Pol oscillator. For small values of ϵ, the closed orbit is a smooth orbit that approximates a circle of radius less than two. Medium values of ϵ result in a closed orbit that is only slightly distorted. It is only for large values of ϵ that the closed orbit achieves a significantly different shape. The hardware implementation of the Rayleigh equation is practically identical to the hardware implementation of the Van der Pol equation.

Figure 6:
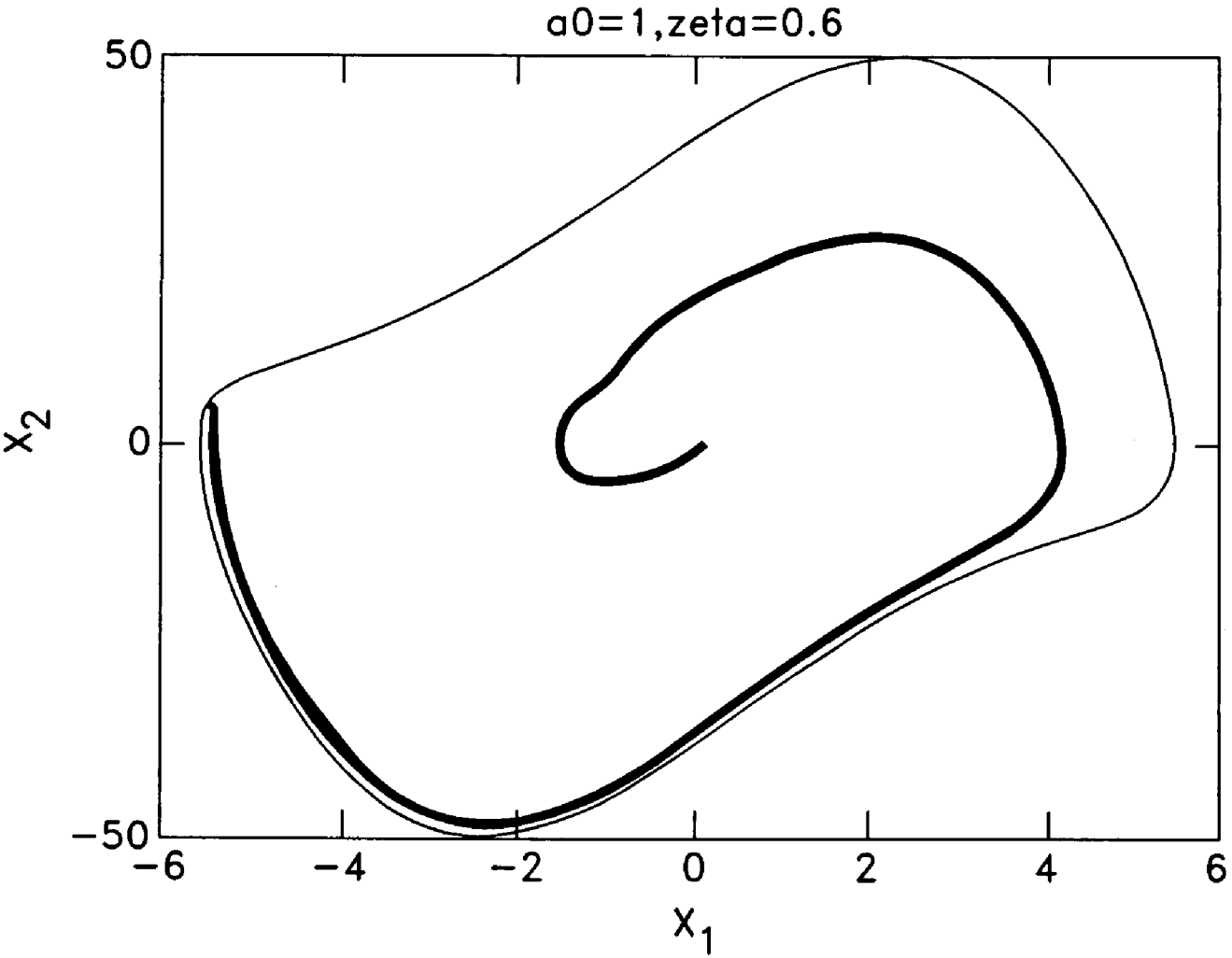
FIG. 6 depicts a typical phase state response of the auto-catalytic oscillator.
Figure 7:
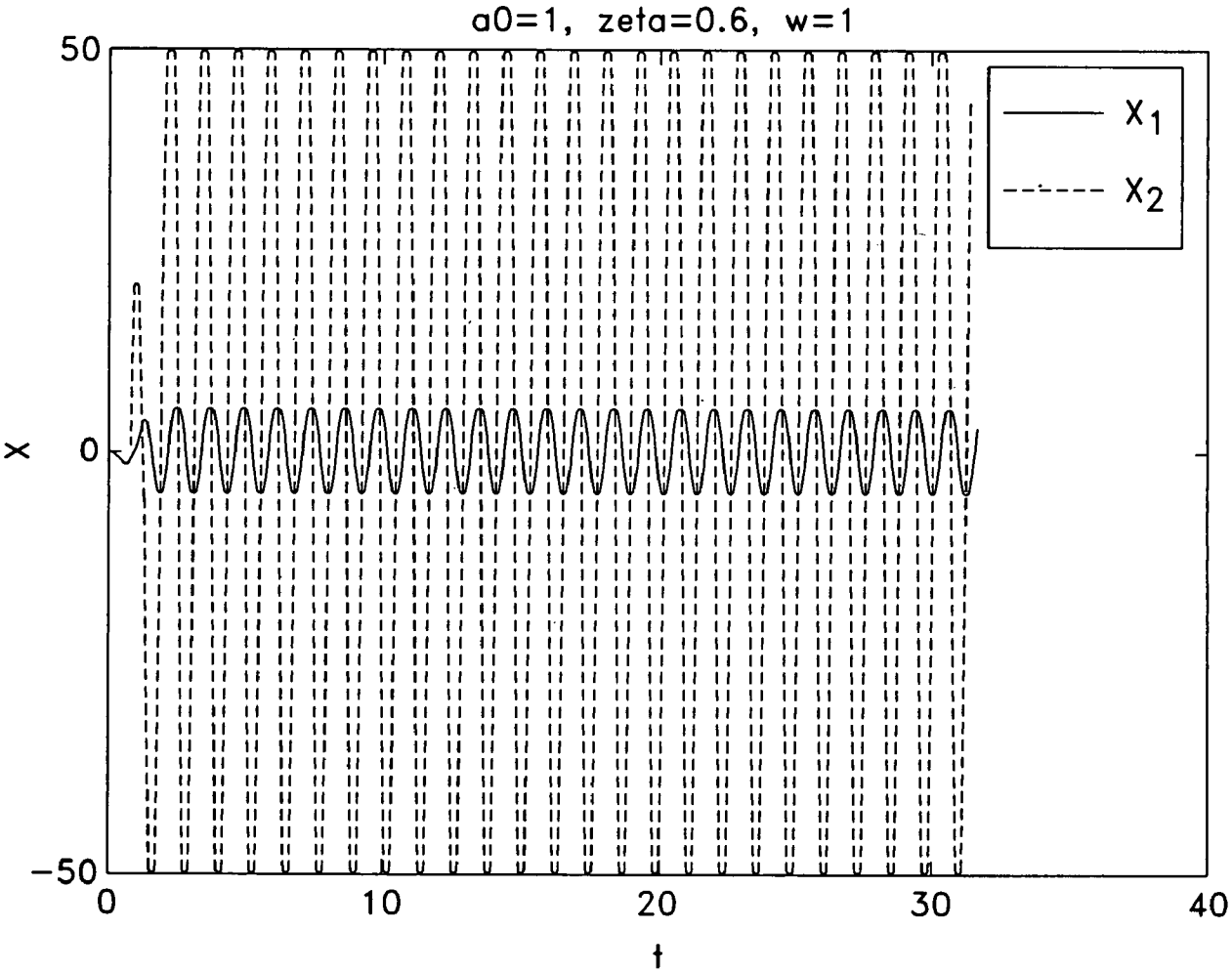
FIG. 7 is an alternate depiction of a typical phase state response of the auto-catalytic oscillator.

A specific example of this auto-catalytic oscillator is when the non-linearities are chosen as:

$$f(x)=\alpha_0x^2-2\zeta_0\omega+\alpha_1x,\ g(x,\dot{x})=\omega^2x \quad (4)$$

and leads to a simple, effective, and robust method for oscillating the foils of the underwater vehicle 100 (See the responses of the auto-catalytic oscillator in FIG. 6 and FIG. 7).

Figure 8:
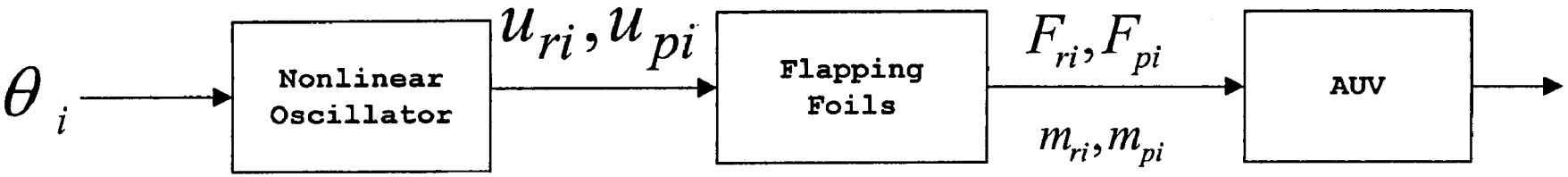
FIG. 8 depicts a schematic block diagram of the controller of an autonomous underwater vehicle using an auto-catalytic non-linear oscillator.

A schematic of the flapping foil operation of a typical autonomous underwater vehicle (AUV) using an auto-catalytic non-linear oscillator is shown in FIG. 8 with parameters of the oscillator; $u_{ri}$, $u_{pi}$ as well as roll and pitching motion of the ith foil. $F_{ri}$, $F_{pi}$, $m_{ri}$, $m_{pi}$ are the hydrodynamic forces and moments that will be sent to drive the autonomous underwater vehicle. The figure depicts how the non-linear oscillator would be integrated with the AUV. The characteristic of the AUV is that the AUV is driven using foils that are articulated in an unsteady manner in which the flapping foils are capable of independent motions of pitch and roll.

Figure 9:
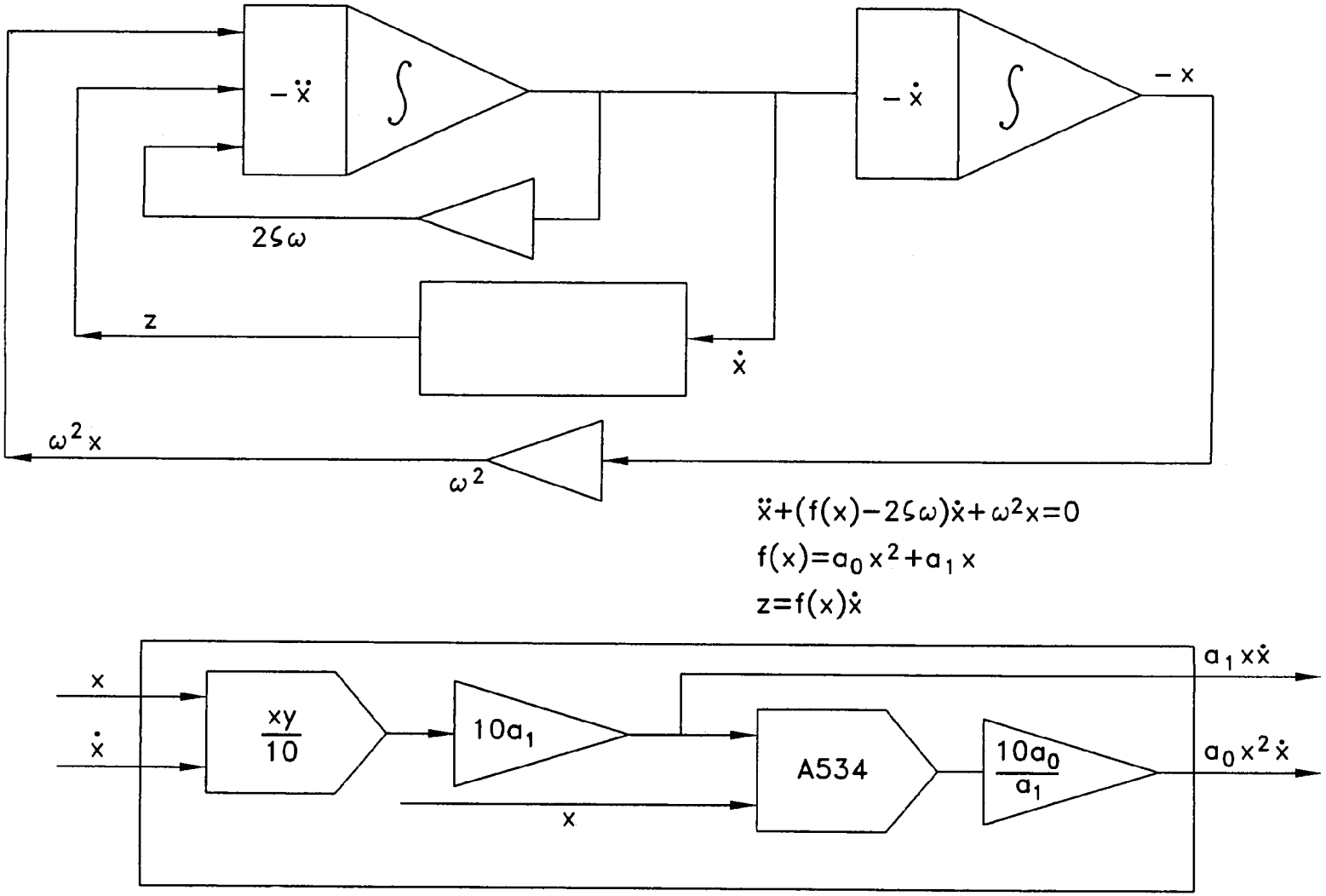
FIG. 9 depicts a block diagram showing a solution method of a Van der Pol oscillator equation.

The non-linear oscillator in the figure employs a non-linear differential equation, which can take a general form as in Equation (3) and Table 1. Equation (4) is one specific realization. This equation can be implemented either in analog form (realized in FIG. 9) or in digital form.

Figure 10:
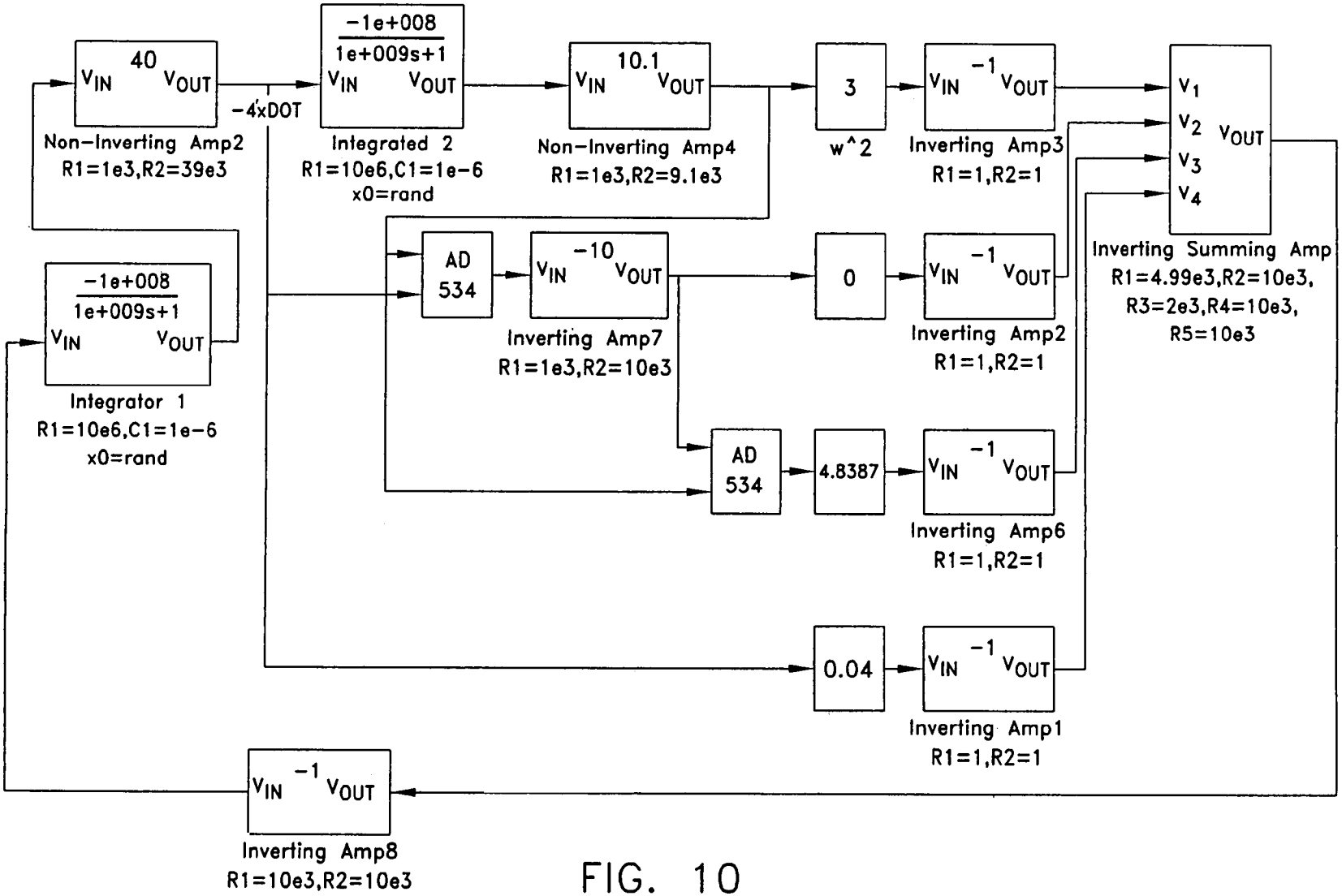
FIG. 10 is a simulation block diagram of a Van der Pol oscillator with Simulink-based implementation of actual hardware components with a first-order filter-based realistic model of non-ideal integrators.
Figure 11:
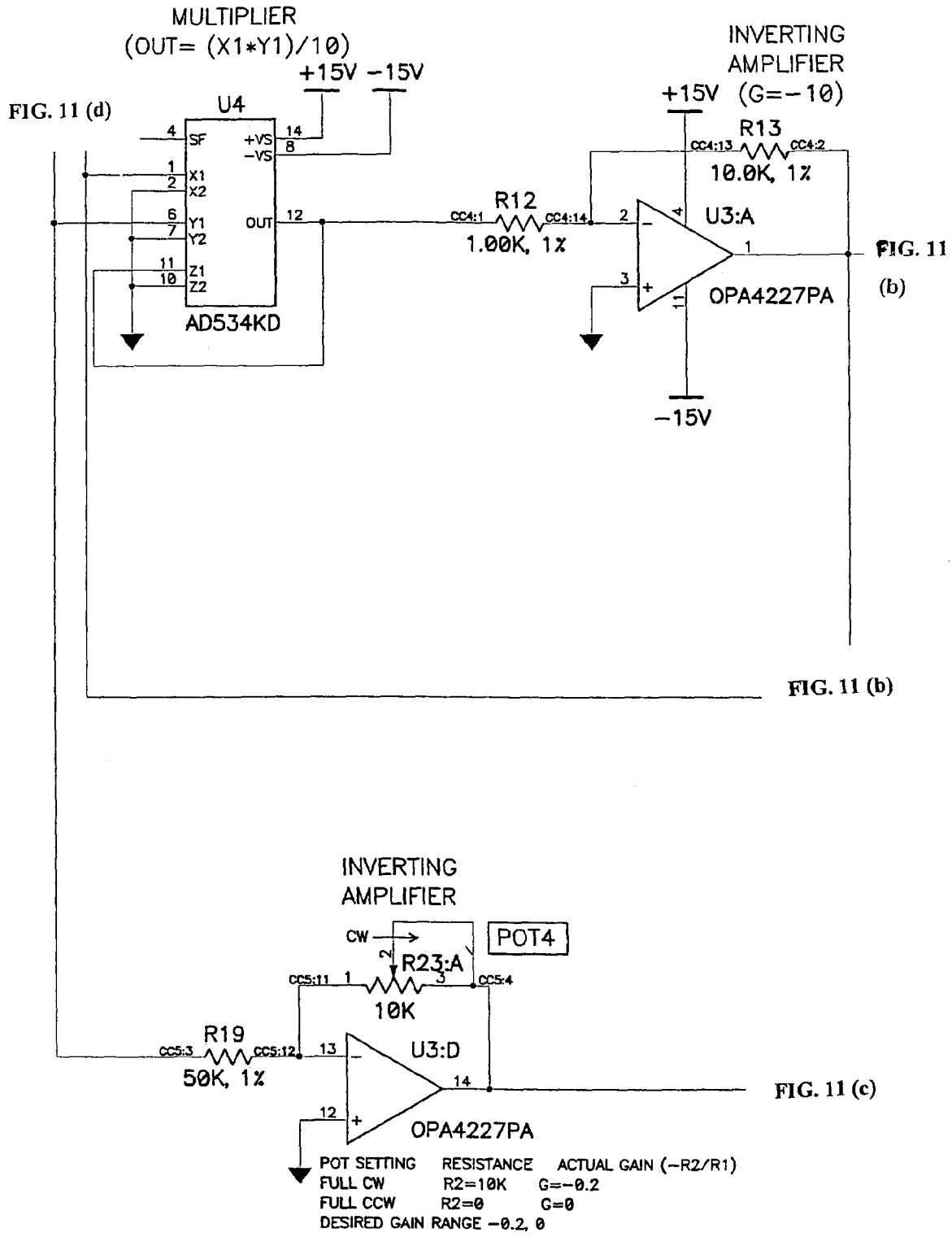
FIG. 11 (*a*)-(*e*) depicts a breadboard schematic of a Van der Pol oscillator with component specifications for fabrication.
Figure 11:
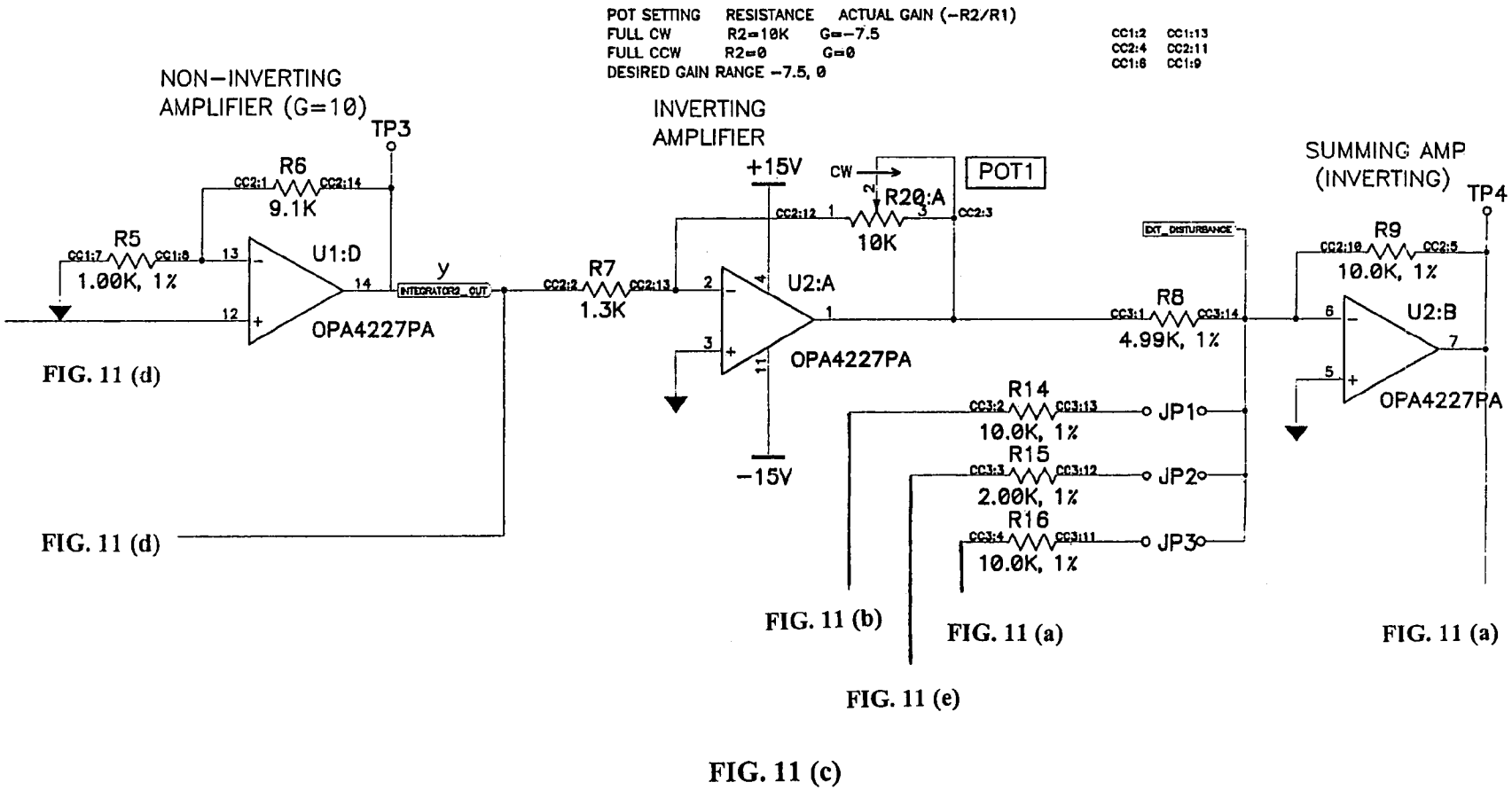
Figure 11:
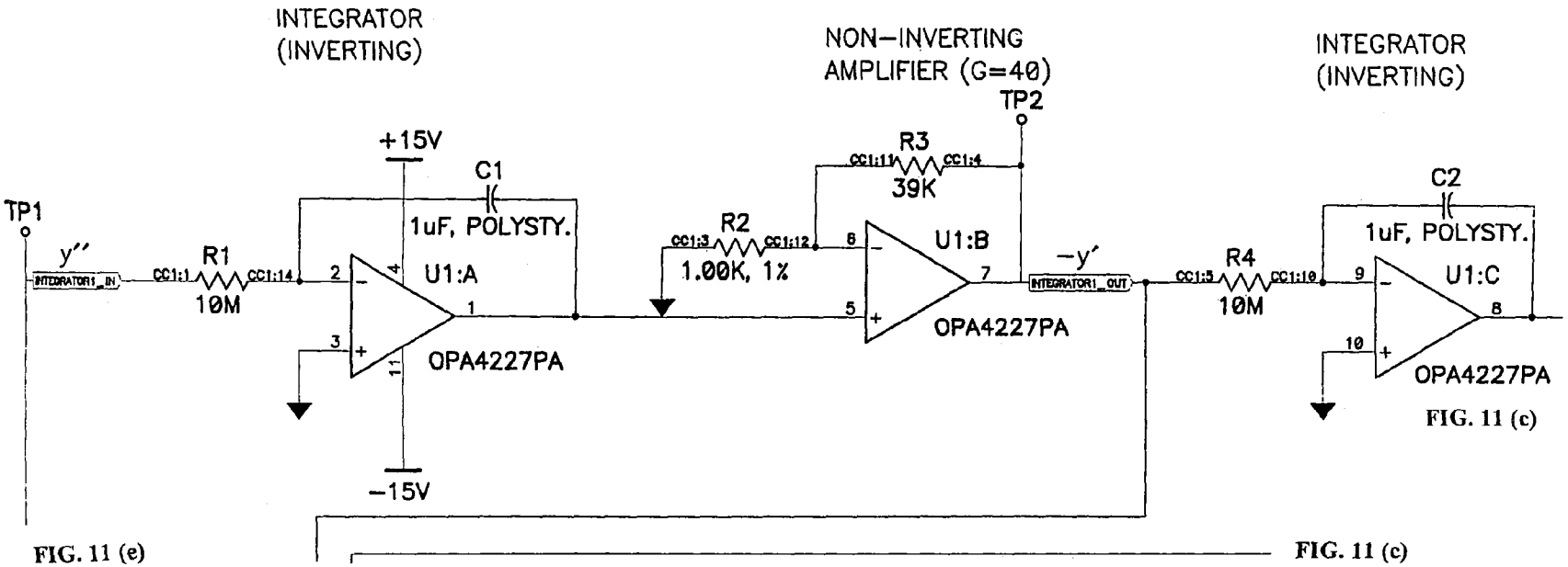

FIG. 10 depicts a block diagram for solving Equation (3) of the Van der Pol type oscillator. FIG. 11(*a*)-(*e*) depict a component hardware diagram for solving Equation (3) of the Van der Pol oscillator.

Figure 12A:
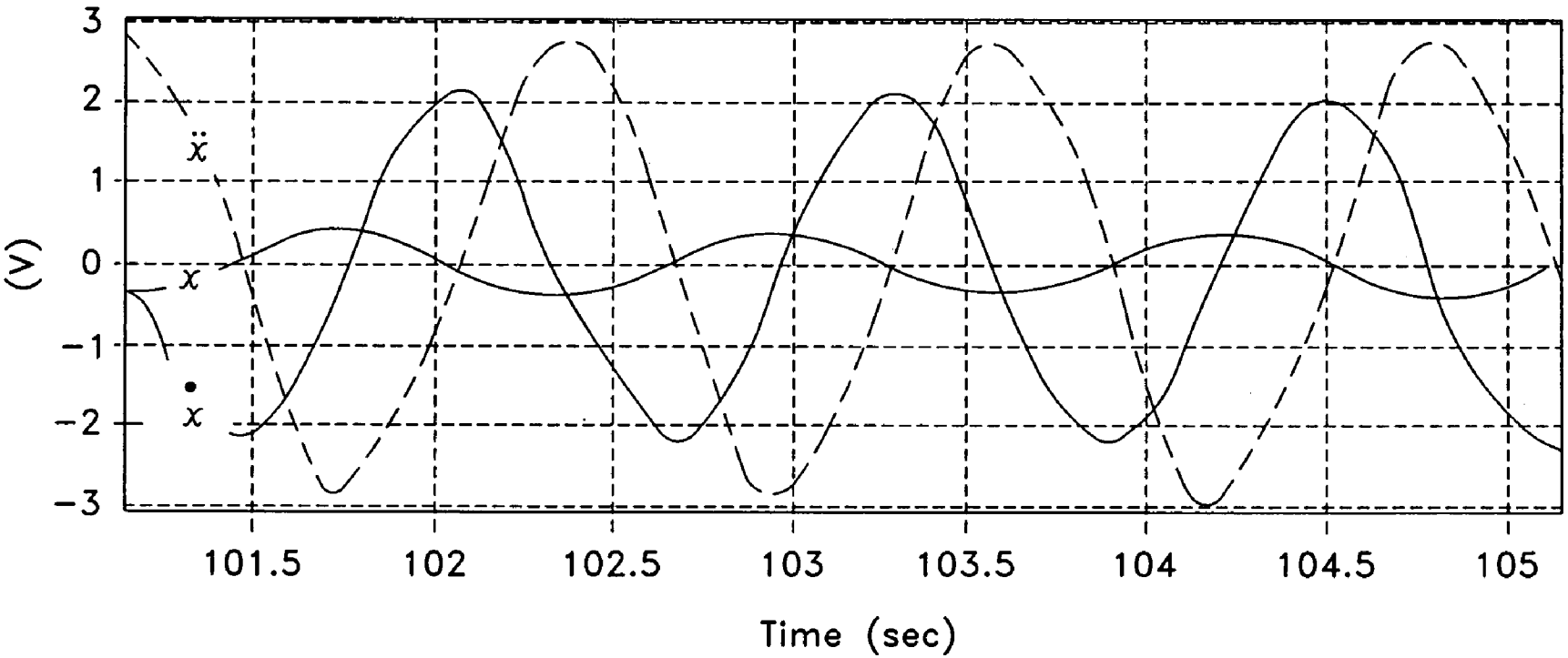
FIGS. 12 (*a*) and (*b*) depict dynamic characteristics as simulations by a comparison of non-linear hardware circuit implementation and simulation.
Figure 12B:
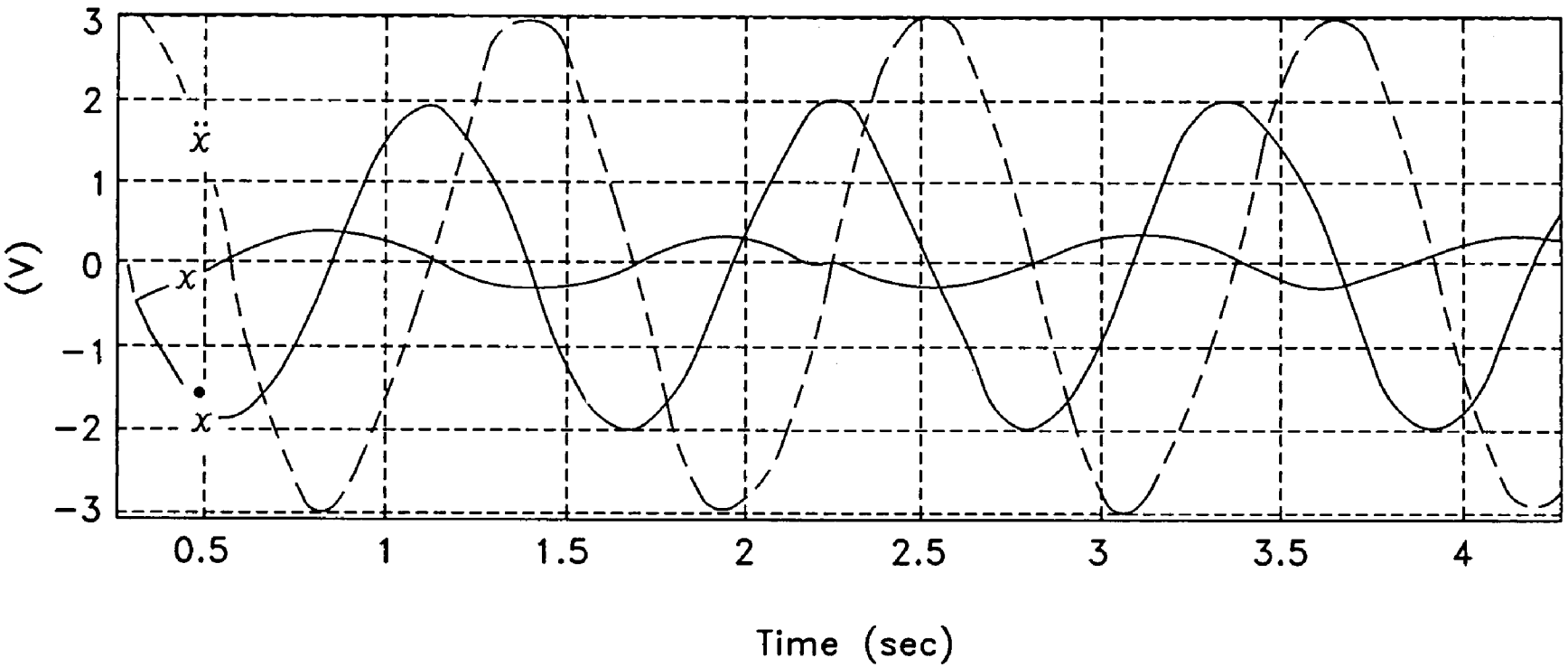
Figure 13A:
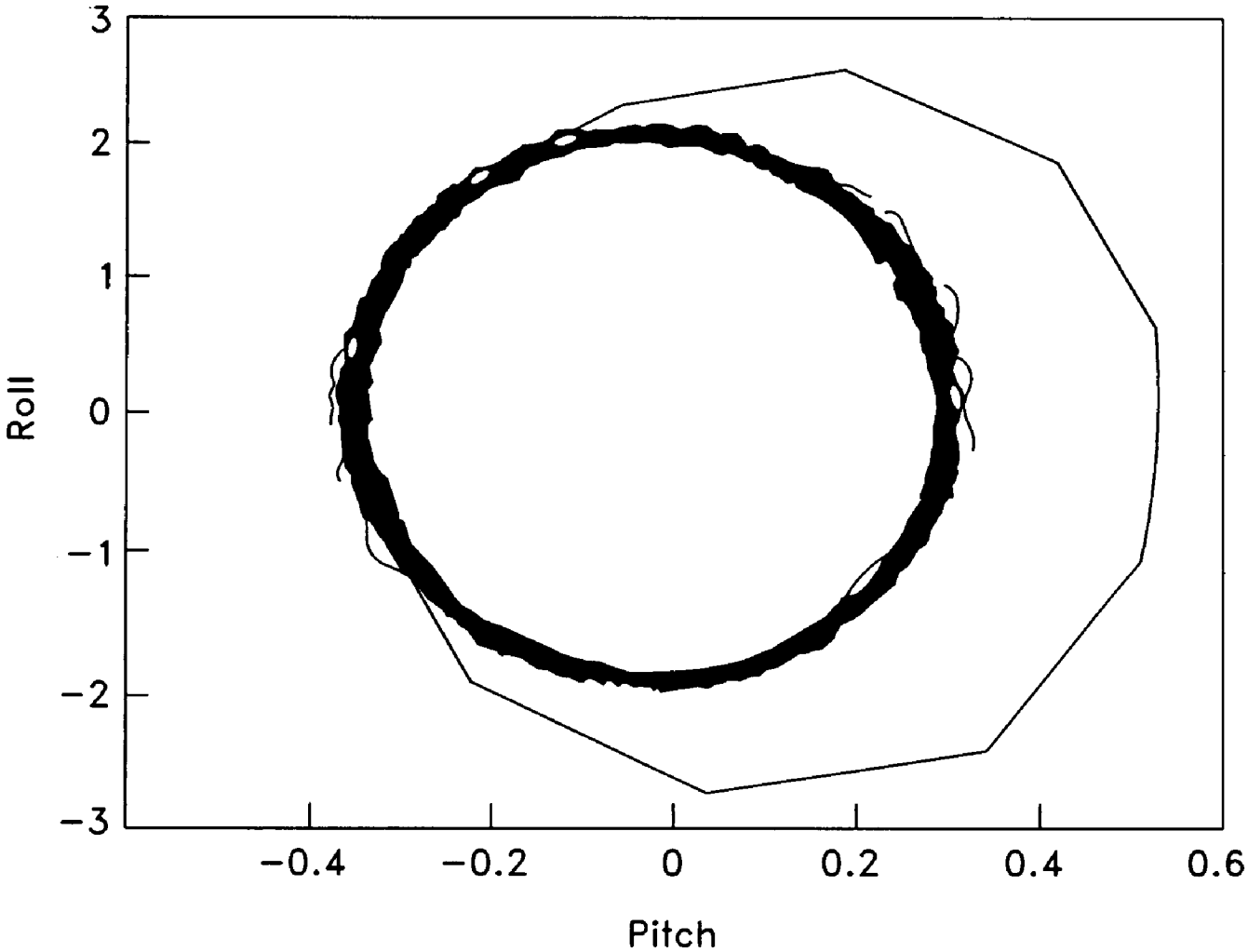
FIG. 13 (*a*)-(*d*) depicts experimental limit cycle disturbance rejection results using Van der Pol oscillator hardware.
Figure 13B:
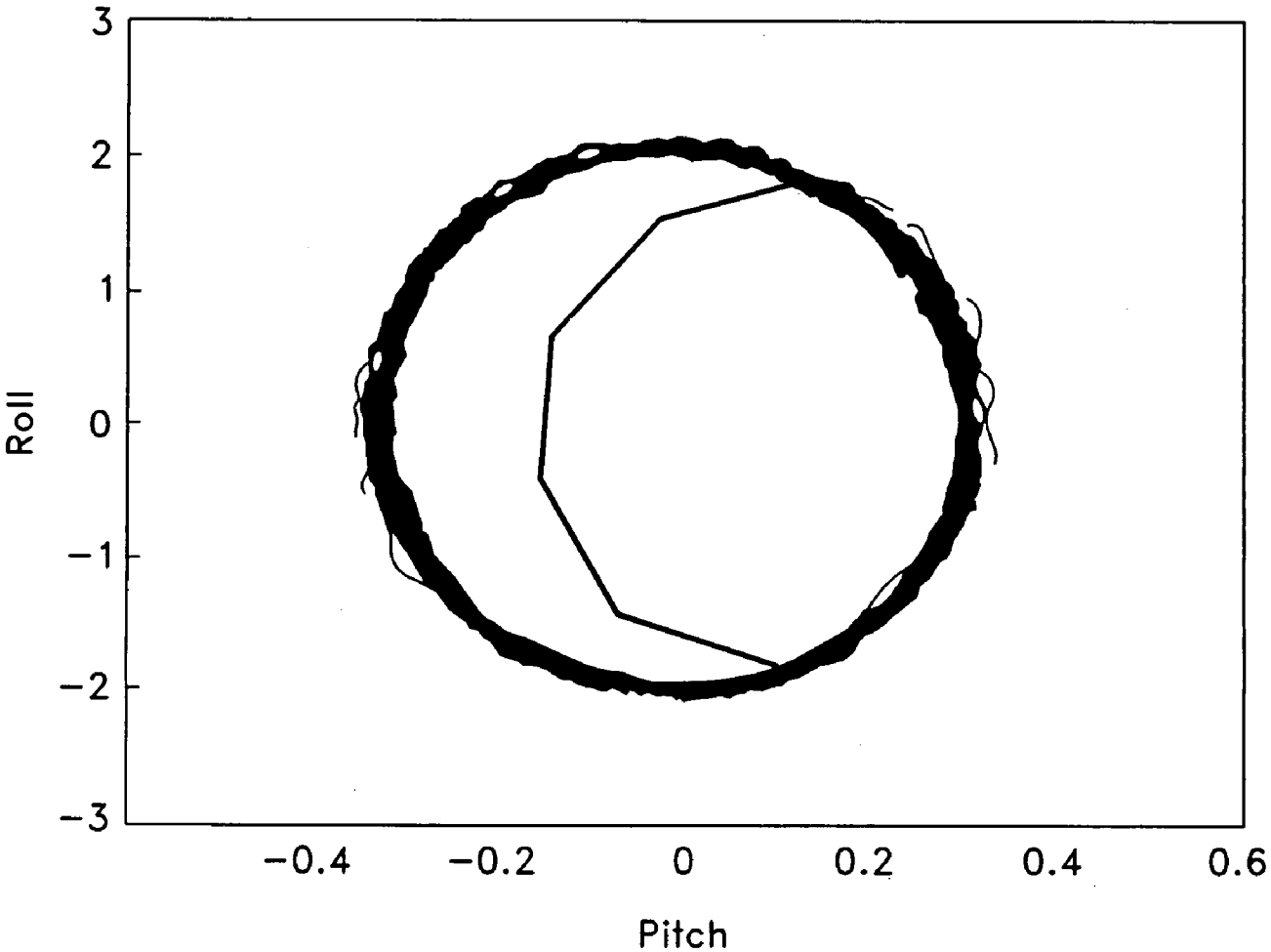
Figure 13C:
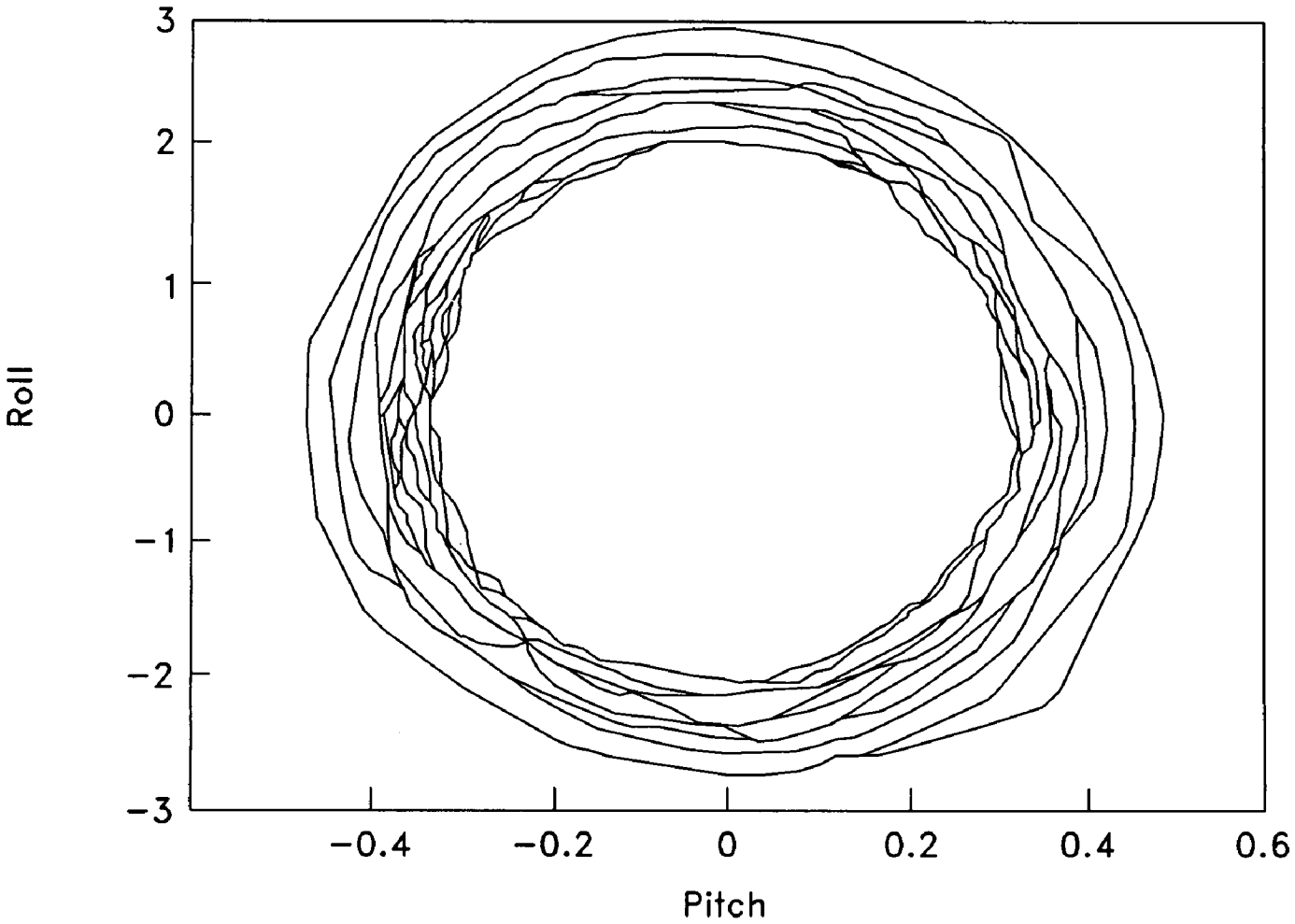
Figure 13D:
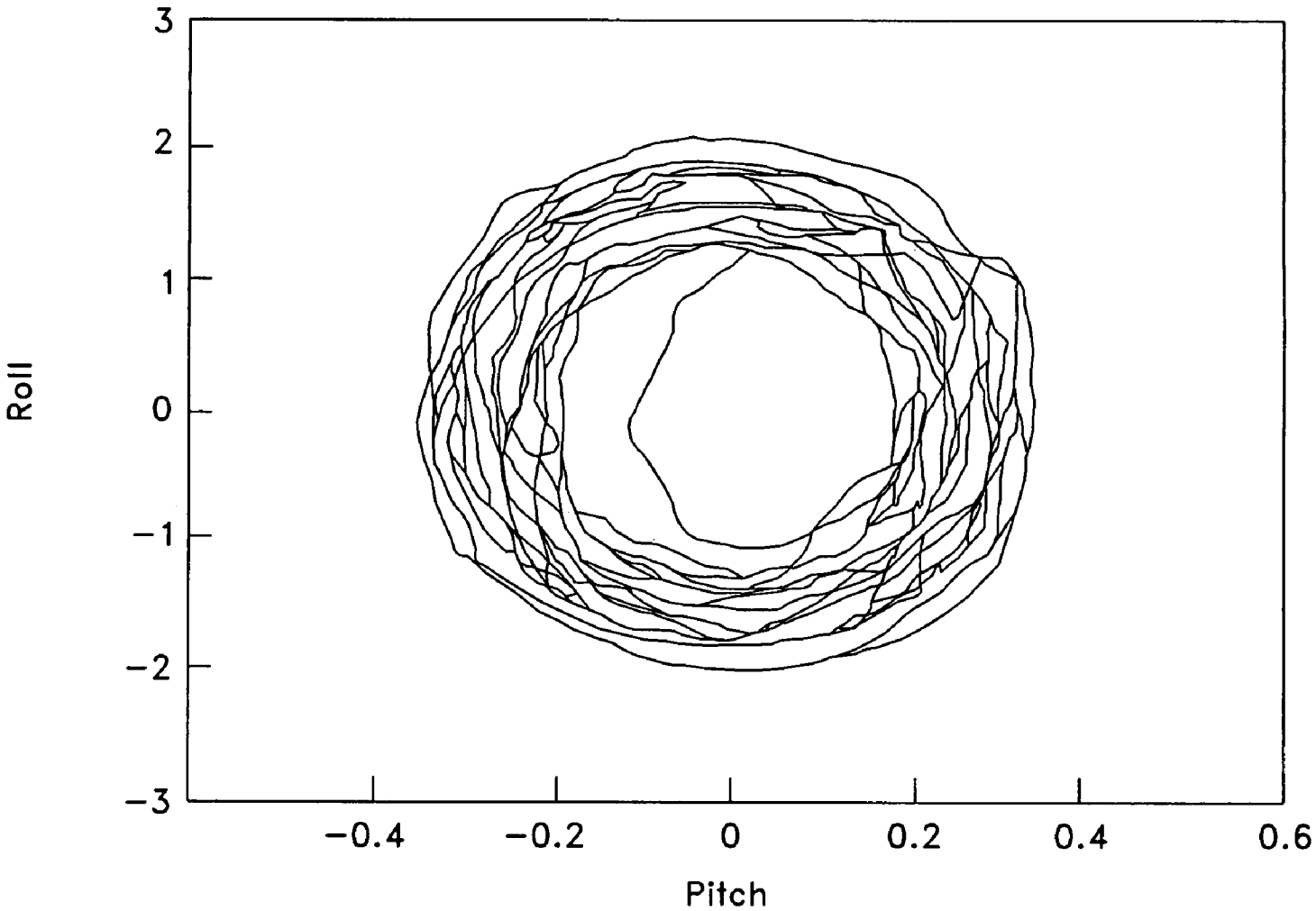
Figure 14A:
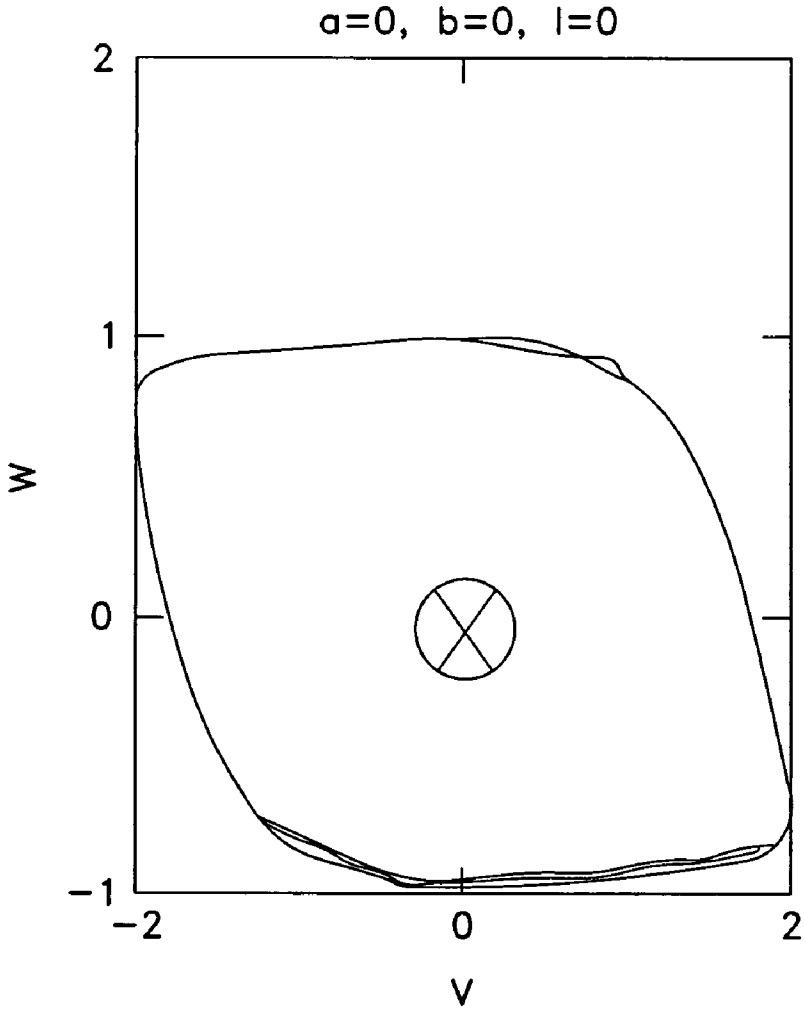
FIG. 14 (*a*)-(*f*) depict a limit cycle of a Lienard oscillator.
Figure 14B:
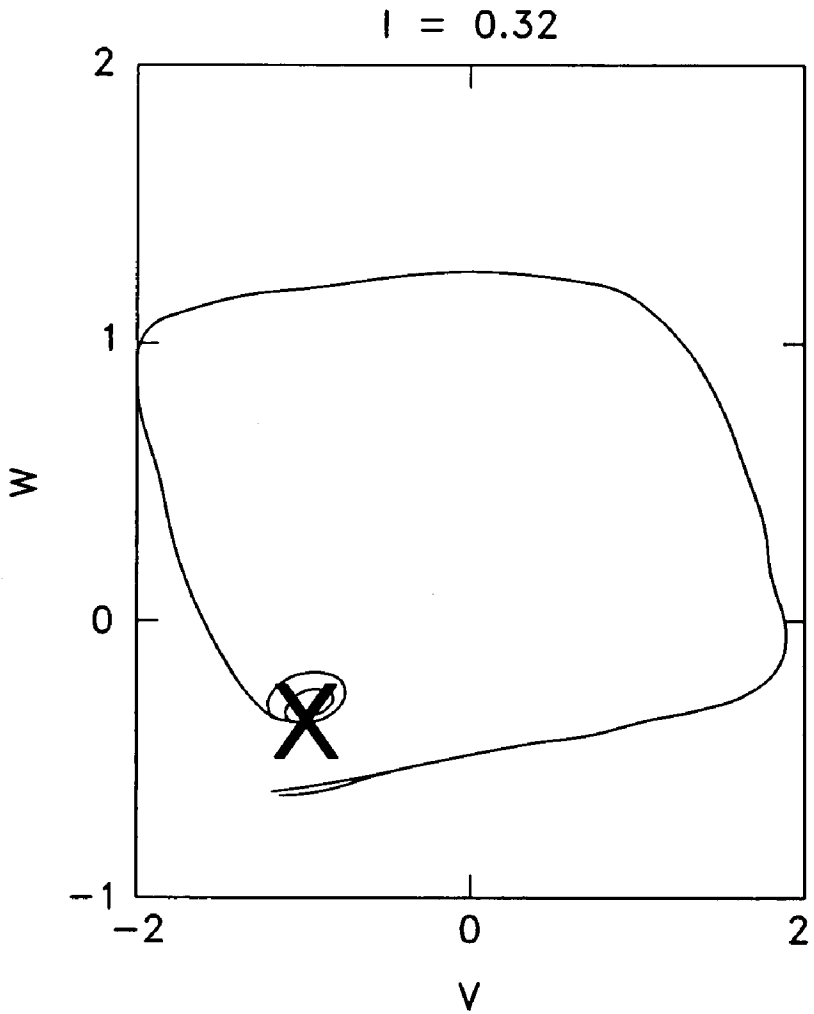
Figure 14C:
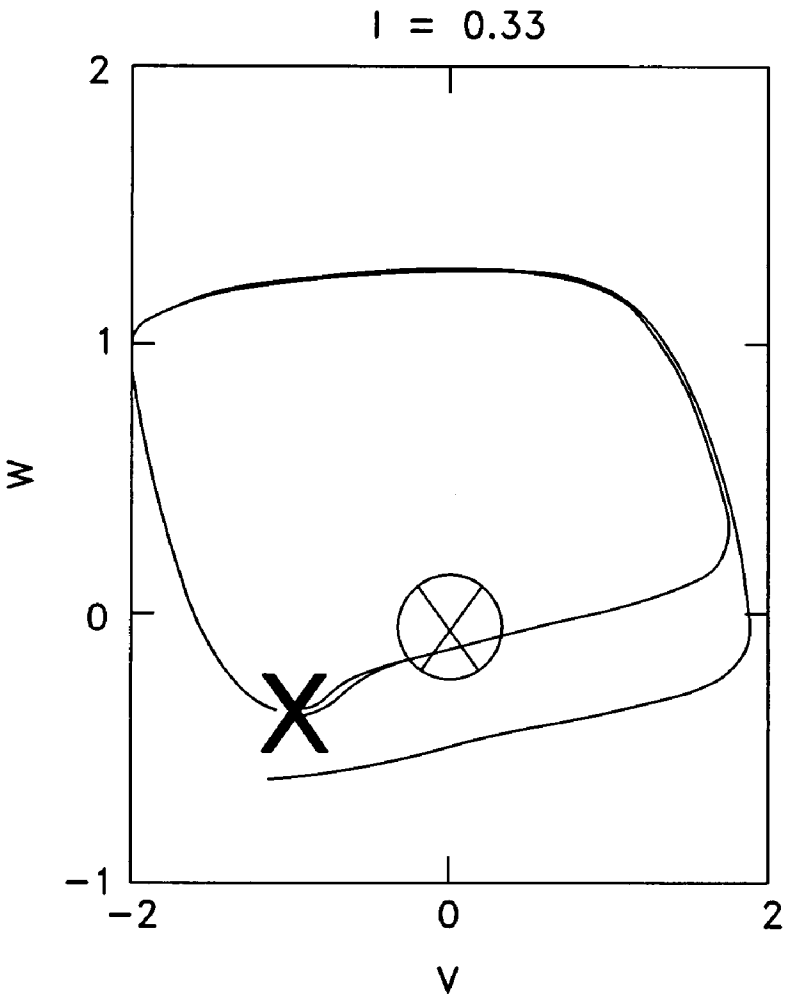
Figure 14D:
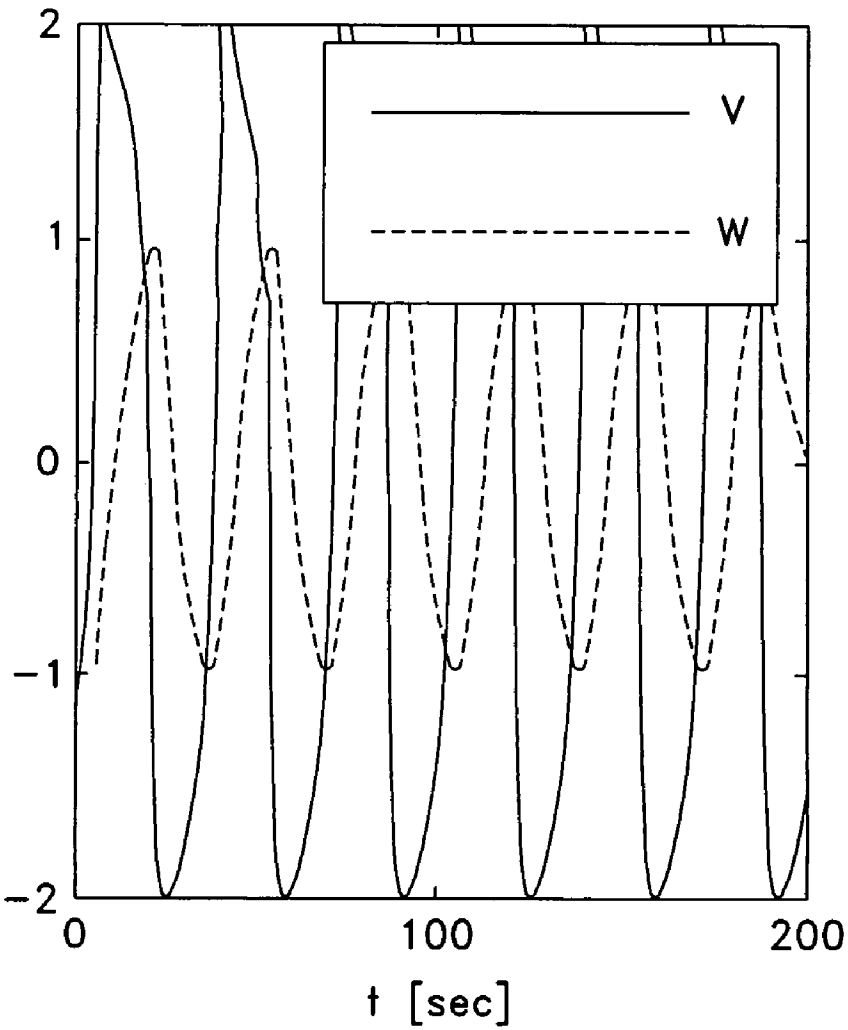
Figure 14E:
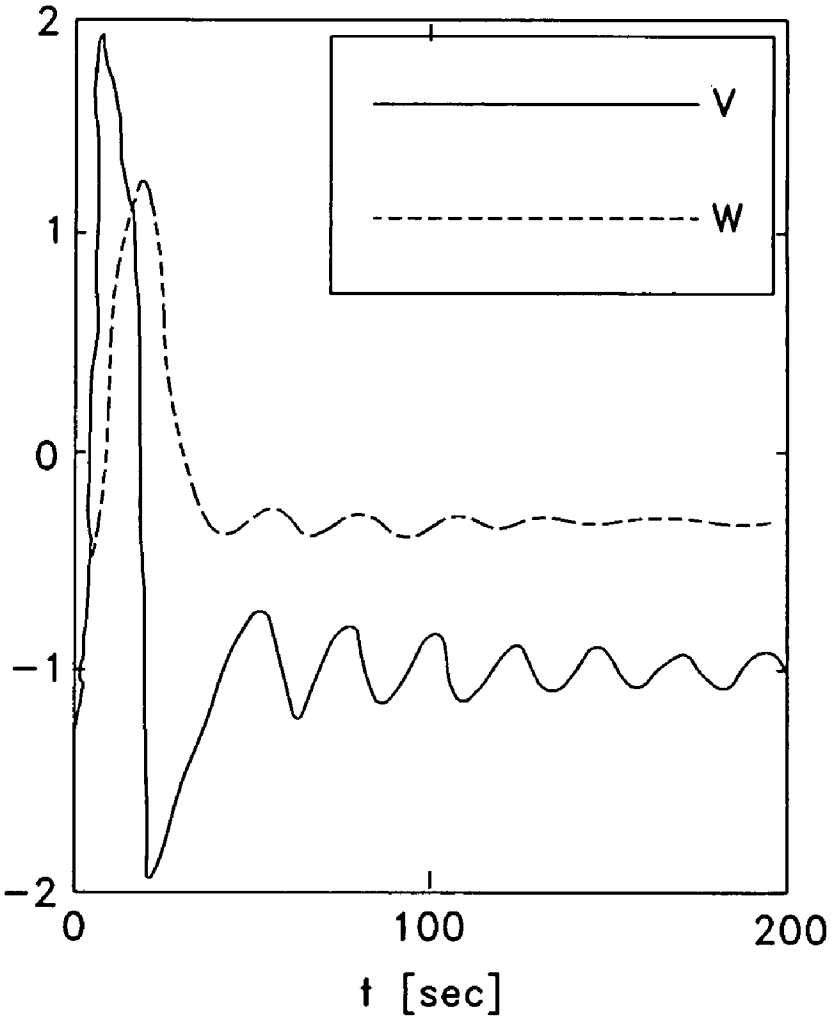
Figure 14F:
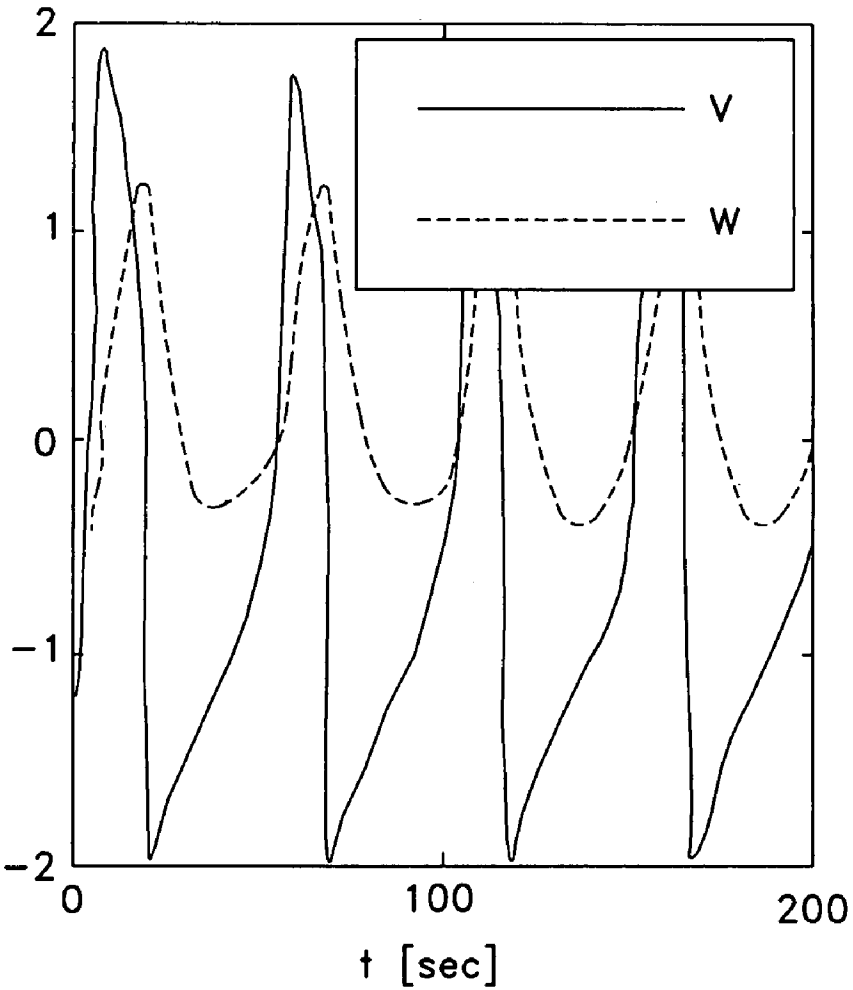

FIGS. 12 (*a*) and (*b*) depict dynamic characteristics by a comparison of non-linear hardware circuit implementation and simulation.

FIG. 13 (*a*)-(*d*) depict experimental limit cycle disturbance rejection results using the Van der Pol oscillator hardware. Rejection both outside and inside the loop are shown in FIGS. 13(*a*) and (*b*). The damping rates are shown in FIGS. 13(*c*) and (*d*).

Non-linear systems where the solution is periodic and sinusoidal do exist. One such example is given by the two coupled first order equations:

$$\dot{x}=-y+x(1-x^2-y^2)$$

$$\dot{y}=-x+y(1-x^2-y^2). \tag{5}$$

Note that Equations (1)-(5) represent the simplest group of non-linear equations that are capable of producing sustained oscillations, and that a significant number of such non-linear systems of second and higher order exist. These systems are known to those ordinarily skilled in the art. A notable of a higher order non-linear oscillator shows that the following mathematical model:

$$\dot{V}=I_i(V,x_1,\ldots,x_3)+I$$

$$\dot{x}_i=f_i(V,x_1,\ldots,x_3),i=1,\ldots,3 \tag{6}$$

is a relatively complete model of a nerve membrane, where "V" represents the membrane potential, "$I_i$" represents the current density through membrane elements, "$x_i$" represents the element state, and "I" is the total current through the membrane. The action potential characteristic of the axon can be explained using the non-linear model in Equation (6).

Note that this model differs from Equations (1) to (5) in the following respects. The first and obvious difference is that the system in Equation (6) is of order four. It should be noted that fundamental theorems such as the Poincare-Bendixson theorem and the Hopf-bifurcation theorem state sufficient conditions on general differential equations of the form of Equation (6) under which a limit cycle must exist.

The second and more important distinction is the presence of the external stimulus I in Equation (6). Because of the non-linear characteristics of the underlying homogeneous system, when the system is probed with an external input, the system exhibits distinctly different characteristics. A qualitative explanation for this behavior is as follows.

As noted previously, non-linear oscillations occur due to the presence of two unique and diverse features, the first feature being an unstable equilibrium point, and the second feature is the presence of a stabilizing non-linearity. The conflicting concomitant presence of these two features can, in some circumstances, lead to an oscillatory exchange. Into such a system, should an external input be introduced, the balance of the unstable and stable pieces is altered, with the specific nature of the alteration depending on the magnitude of the input. For instance, if this input is sufficiently large, then the destabilizing action can become dominant, driving all solutions of the system towards a fixed point, and when this input is removed, the system returns to an oscillatory behavior, thereby causing the response to a pulse input to consist of a combination of a dash toward a specific value and a return to an oscillatory mode, i.e., a spike. The presence of two external inputs where one is stabilizing and the other is destabilizing can once again produce decaying action or yet another limit cycle. For instance, suppose that the Lienard equation is altered to include external influences "I" and "a" as $$\dot{V}=f(V)-x_1+I$$

$$\dot{x}_1=\omega^2(V+\alpha-bx_1) \tag{7}$$

where a and b are positive constants.

FIG. 14 (*a*) through (*f*) show that with or without a stimulus, the underlying non-linear system is capable of producing a limit-cycle with the exact nature of the periodic signal altered by the nature of the external stimulus. The figures show that the Lienard oscillator in Equation (7) exhibits a limit cycle in the absence of any extra stimulus. A stabilizing influence is introduced by setting a=0.7, b=0.8 and a destabilizing stimulus via I=0.32. Note that the trajectories return to a resting point causing the impulse trains to dwindle to zero, since the stabilizing actions overpower the unstable ones. As the stimulus is increased slightly to 0.33, the balance tips in favor of instability, causing the impulse trains to sustain, i.e. resulting in a limit-cycle. The "ⓧ" and "x" respectively denote in FIG. 14(*a*)-(*c*) the equilibrium points of the Lienard oscillator with or without external inputs.

The impulse trains in Equation (7) and those produced by the equations in Equation (6) are quite similar, with the descending phase of the latter made less severe by replacing the damping effect in Equation (7) (which is the term −b) by a term of the form $f_1(V)$. Nevertheless, the underlying nature of the low-order equations in Table 1 and the equations in Equation (6), of limit-cycle generation, is the same. Whether second or higher-order, whether an external stimulus is present or not, it is possible to generate sustained impulse trains or other periodic oscillations using a group of non-linear oscillators. All of these oscillators have the desired property of robustness to brief disturbances.

It could perhaps be argued that the simplest of these is the Van der Pol oscillator in Equation (3). If it is of interest in a given application to produce a specific impulse train, then more careful selection and customization of a specific member of this group is called for. In the current context of autonomous vehicle locomotion, since the goal is to produce a periodic flapping motion that is robust but is no more specific, attention is restricted to generation of flapping motion using the Van der Pol oscillator.

Robustness of Auto-Catalytic Oscillators

Figure 15:
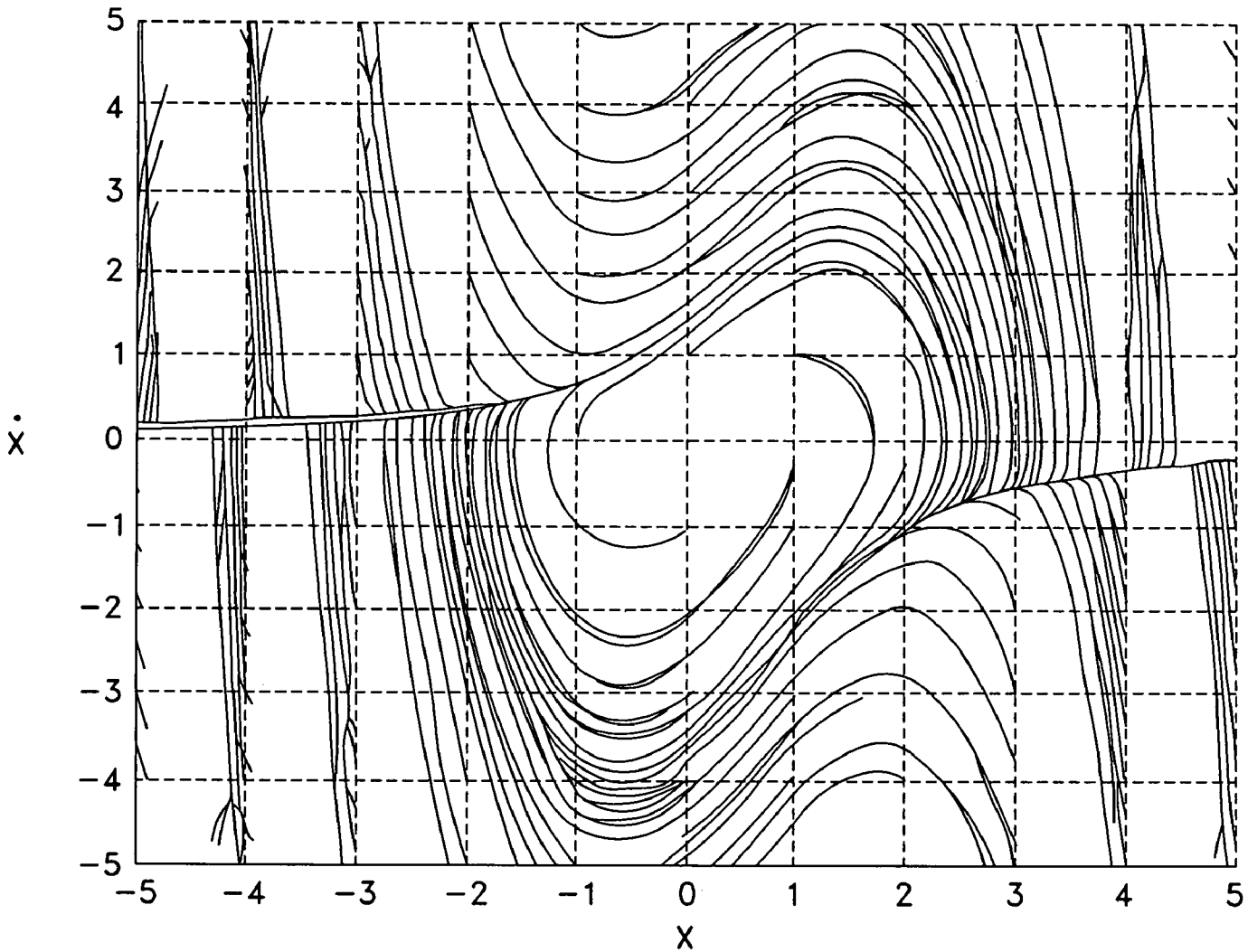
FIG. 15 depicts a phase plot of a typical Van der Pol oscillator.
Figure 16:
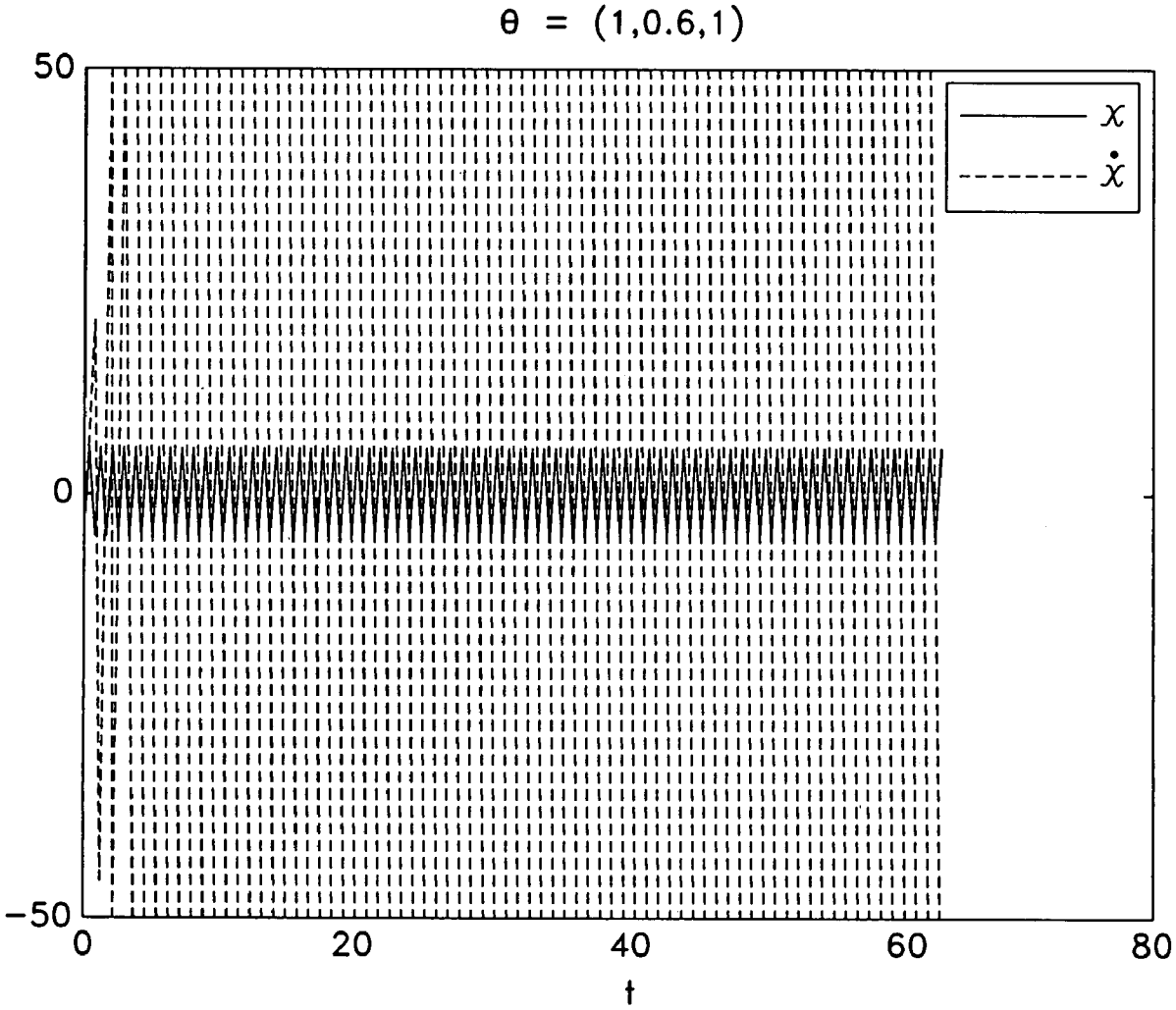
FIG. 16 depicts a time plot of a typical Van der Pol oscillator.

Using the auto-catalytic oscillators that were introduced in Equation (3), a variety of sustained oscillations can be produced that can reject external disturbances. The oscillator in Equation (3) simulates for different values of $\theta=(\alpha_0,\zeta_0,\omega)$. A typical response for $\theta=(1, 0.6, 1)$ is shown in FIG. 15 and FIG. 16. The phase plots and the time plots of x and $\dot{x}$ are shown in FIG. 15 and FIG. 16, respectively.

In FIG. 15, each trajectory results from a different initial condition (corresponding to the gridpoints). All initial conditions lead to the stable orbit [except (0,0), which is a stable point]. The length of each arrow (collinear with the graphical indices of "x") is proportional to the "speed" at that point. For small values of x, the speed is relatively small. An initial condition of $x(0)=0.1$ and $\dot{x}(0)=0.1$ generates the plot of FIG. 16.

It can be seen that the response is periodic and non-sinusoidal, and that the two states x and $\dot{x}$ are always 90° out of phase, and can be used to respectively drive the roll and pitch flapping foils. An increase in $\alpha_0$ and $\omega$ leads to an increase in the amplitude and frequency, while an increase in $\zeta_0$ controls the speed of convergence of the trajectory to the limit cycle. It should be noted however that no offset is produced by the Van der Pol oscillator and that the response is symmetric about zero. This can be rectified by altering the non-linearity "f" in Equation (3) as $$f(x)=\alpha_0 x^2-2\zeta_0\omega+\alpha_1 x, \tag{8}$$

where depending upon whether "$\alpha_1$" is positive or negative, a corresponding positive or negative offset is produced. It is again emphasized that similar periodic oscillations can be generated by using any of the simple second order non-linear differential equations described earlier, with flexibility in varying the amplitude, phase, and frequency of the resulting periodic signals.

The fact that the solution of a non-linear autocatalytic oscillator is a unique and stable periodic orbit implies that any perturbations to the trajectory diminish fairly quickly. This is illustrated in FIG. 15 where the oscillator is periodically pulsed. It is seen in the figure that after each pulse, the trajectory returns to limit cycle comparatively quickly. The robustness of the non-linear auto-catalytic oscillator in Equation (3) with the non-linearity f(x) of the form of Equation (8) is therefore an intrinsic property. Note in FIG. 15 that the stable orbit is no longer symmetric and has some "bias" due to the additional term in f(x).

Returning to FIG. 12(*a*) and (*b*), the figures depict a verification of the Van der Pol oscillator using analog circuitry. FIG. 12(*a*) depicts the response of x, $\dot{x}$, $\ddot{x}$ from an iterated simulink design. FIG. 12(*b*) depicts the response of the wire-wrap breadboard.

The oscillator design can be achieved on a wire-wrap breadboard using commercially available passive components, op-amp-based integrators, inverting and non-inverting amplifiers, and summing amplifiers. The polynomial non-linearities in the oscillator can be implemented using Analog Devices precision multiplier integrated circuits. The resulting schematic and wire-wrap board layout is shown in FIG. 11 (*a*)-(e) and is supported by TABLE 2. The schematic is divided into an acceptable format for presentation.

TABLE 2

Van der Pol Oscillator Hardware Implementation (Breadboard)

| Base Sheet | Adjoining Sheet (1) | Adjoining Sheet (2) | Adjoining Sheet (3) | Adjoining Sheet (4) |
|---|---|---|---|---|
| FIG. 11(a) | FIG. 11(b) | FIG. 11(c) | FIG. 11(d) | |
| FIG. 11(b) | FIG. 11(a) | | FIG. 11(e) | |
| FIG. 11(c) | FIG. 11(a) | FIG. 11(b) | FIG. 11(d) | FIG. 11(e) |
| FIG. 11(d) | FIG. 11(a) | FIG. 11(c) | FIG. 11(e) | |
| FIG. 11(e) | FIG. 11(b) | FIG. 11(c) | FIG. 11(d) | |

The oscillator is constructed using operational amplifiers (shown as triangles with resistances, grounds, and capacitances) and precision multipliers (shown as squares). The former is used to perform the action of an integrator (when a capacitance is connected across the op-amp) and an inverter (when a resistance is connected across the op-amp). As shown in the figure, there are two integrators, since the oscillator is of second order, and there are eight inverters that perform multiplication by suitable constants as needed to simulate the linear components of the oscillator. The two multipliers allow the generation of the cubic non-linearity in the oscillator.

Figure 17:
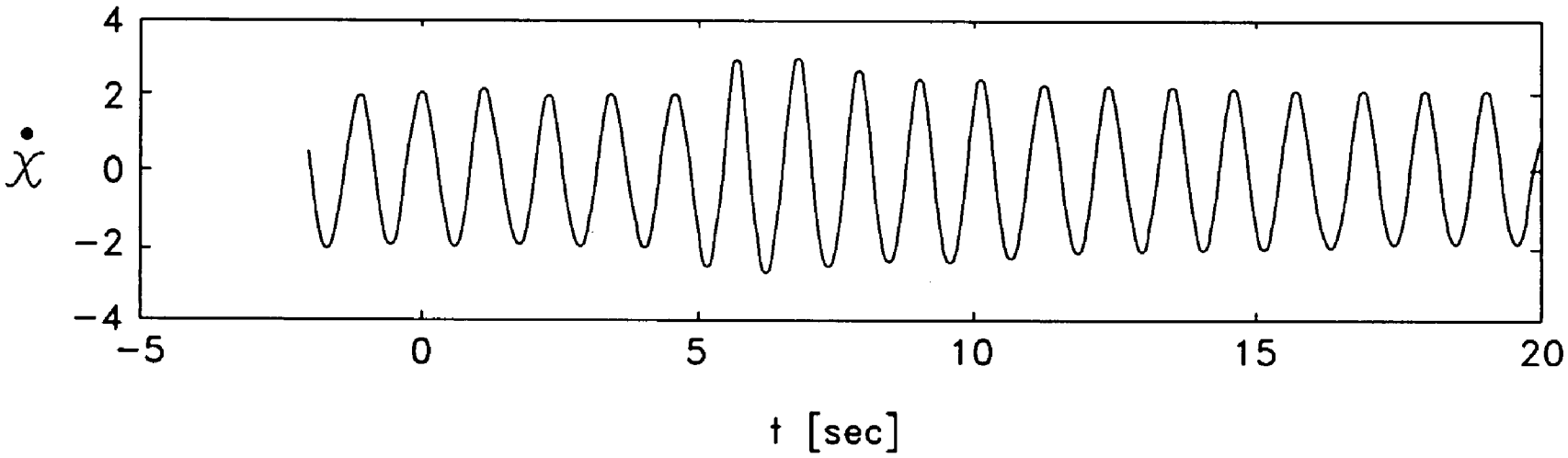
FIG. 17 depicts performance of the auto-catalytic oscillator before a disturbance.
Figure 18:
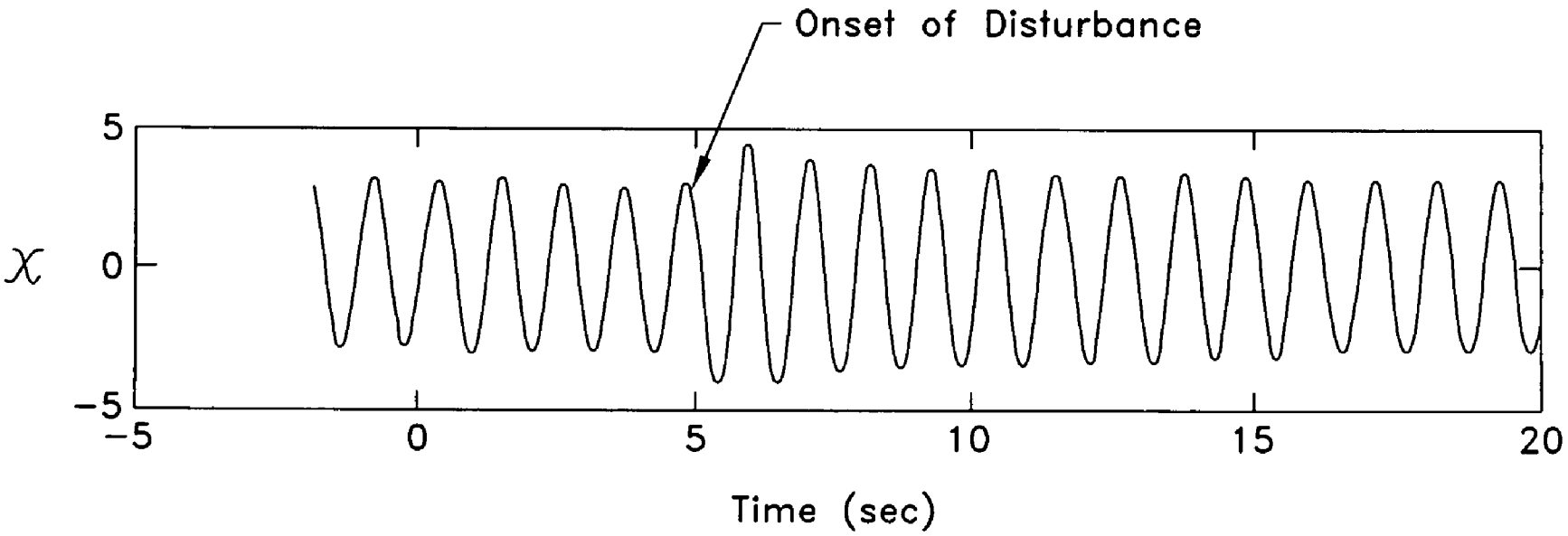
FIG. 18 depicts performance of the auto-catalytic oscillator after a disturbance at t=5 sec.

In order to demonstrate the disturbance rejection effectiveness of the circuit, a pulse is introduced at t=4.5 sec, and as shown in FIG. 17 and FIG. 18, the response quickly returns to a periodic state thereby demonstrating the robustness property of the oscillator.

Figure 19:
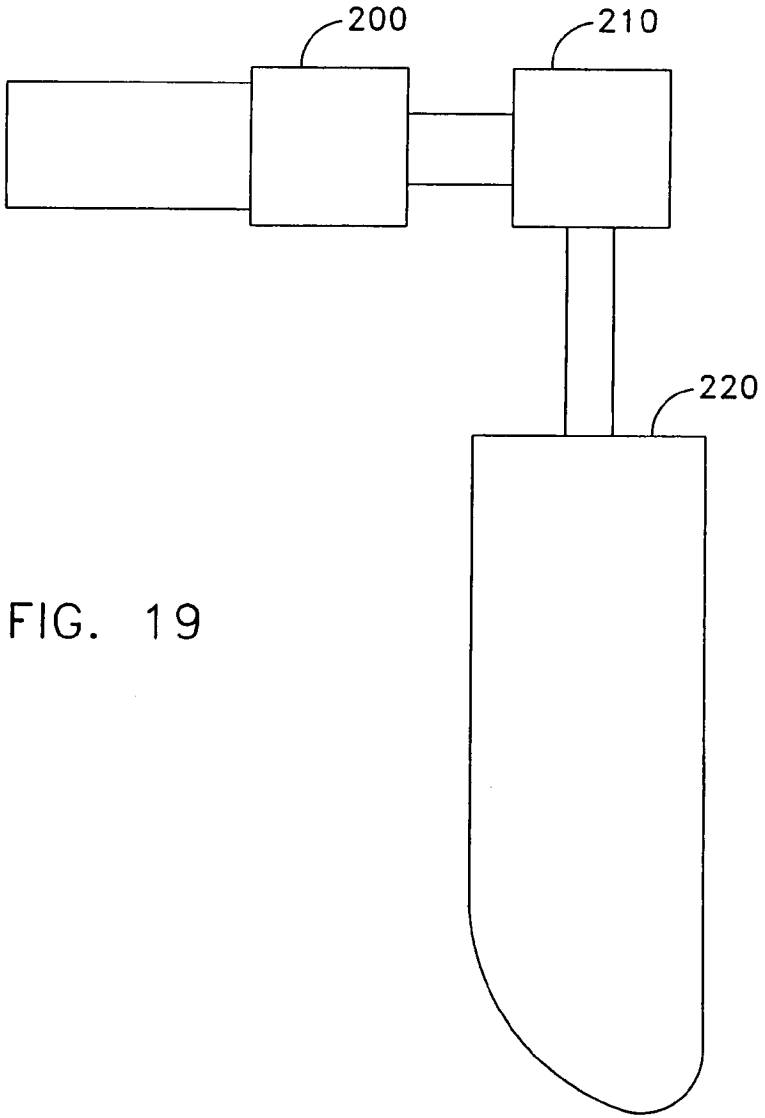
FIG. 19 depicts an experimental high-lift foil.

To further validate the behavior of the oscillator, an oscillator model is synthesized and used to drive a flapping fin. (See mechanical arrangement motor 200, 210 and 220 of FIG. 19). The experimental apparatus would mount over a water tank.

Figure 20:
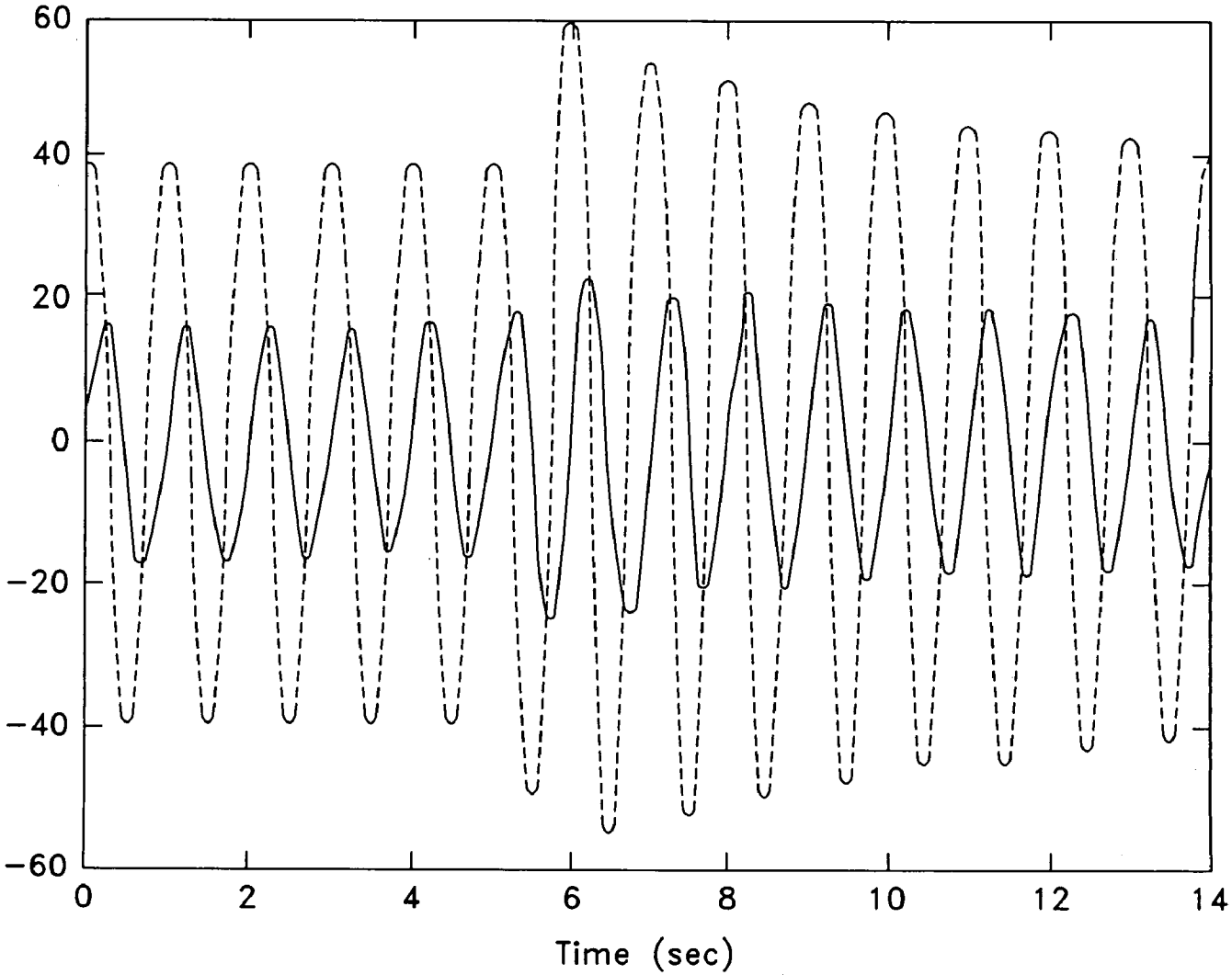
FIG. 20 is a graphical depiction of roll and pitch motions of a single foil before and after a pulse-disturbance.
Figure 21:
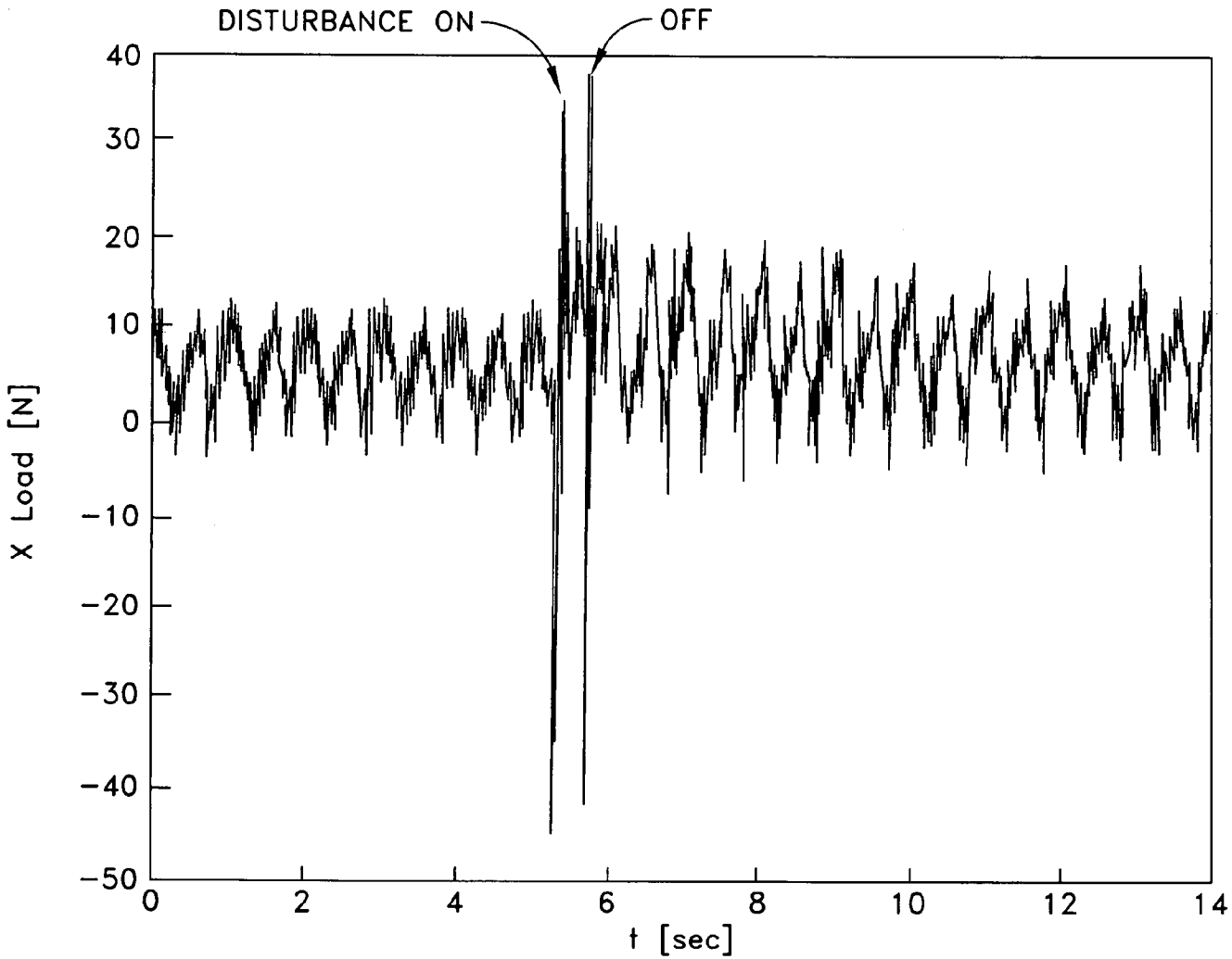
FIG. 21 is a graphical depiction of a longitudinal force generated by a single foil before and after a disturbance with the force returning to an undisturbed level once the disturbance is removed.

The oscillator model is added to a conventional motor control model, where the outputs x and $\dot{x}$ of the oscillator drive the roll and pitch positions of the foil, respectively, in real-time. Two different oscillatory profiles are tested, where one is close to a sinusoid while the other is different. In both cases, the flapping foils exhibit a satisfactory motion. Also in both cases, a pulse disturbance is added and the motion is shown to return to equilibrium (See FIG. 20 for the dotted line being the pitch and the solid line being the roll). Similarly, the forces and moments generated with the non-linear oscillator show the same disturbance rejection property (see FIG. 21), and that the forces and moments are capable of driving an underwater vehicle.

Figure 22:
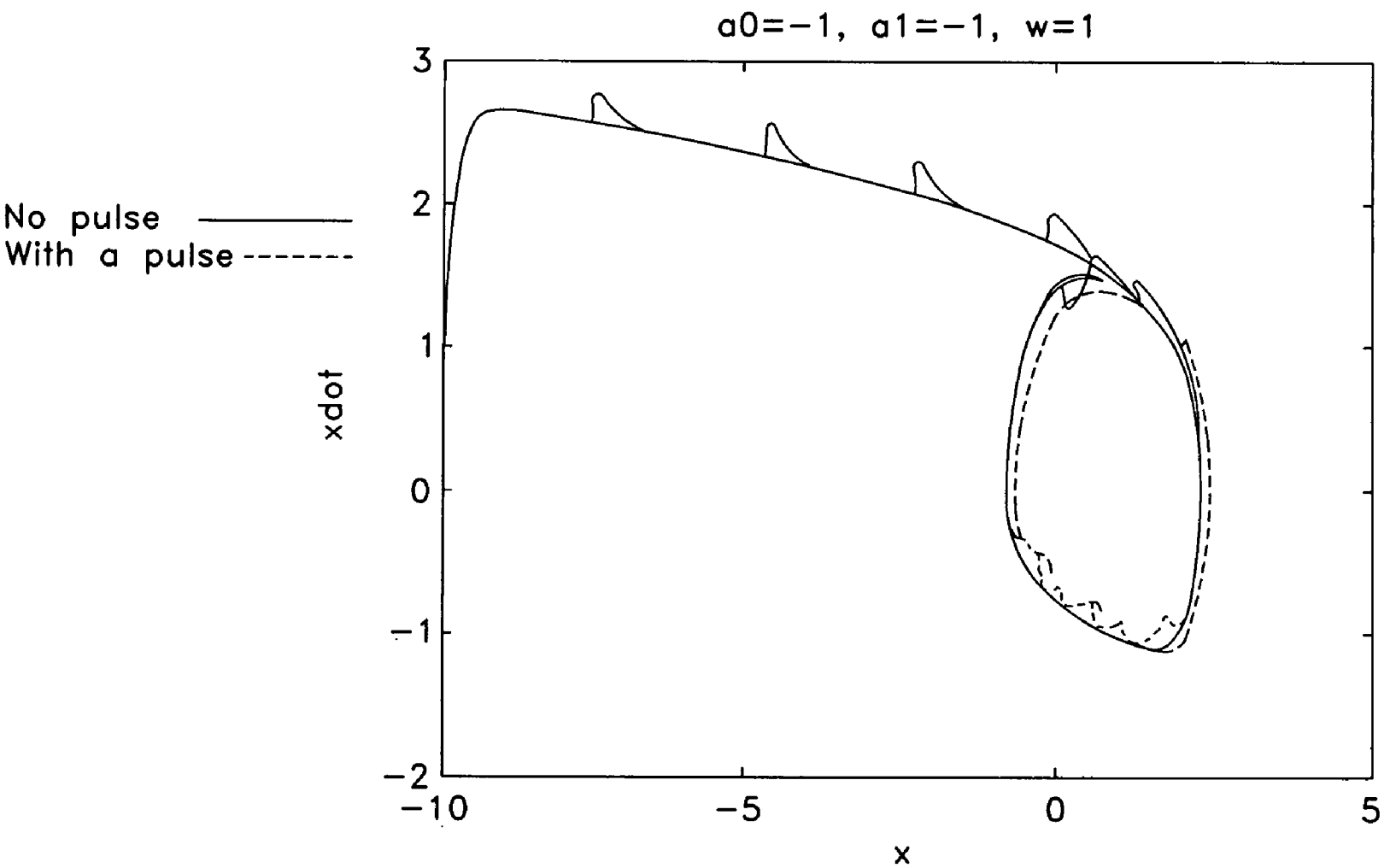
FIG. 22 depicts the robustness of a non-linear oscillator with respect to external pulses.

In an alternate view, when a pulsed disturbance is applied to the foil; the ability of the oscillator to restore the preset foil oscillation parameter is shown by the results of FIG. 22.

Figure 23:
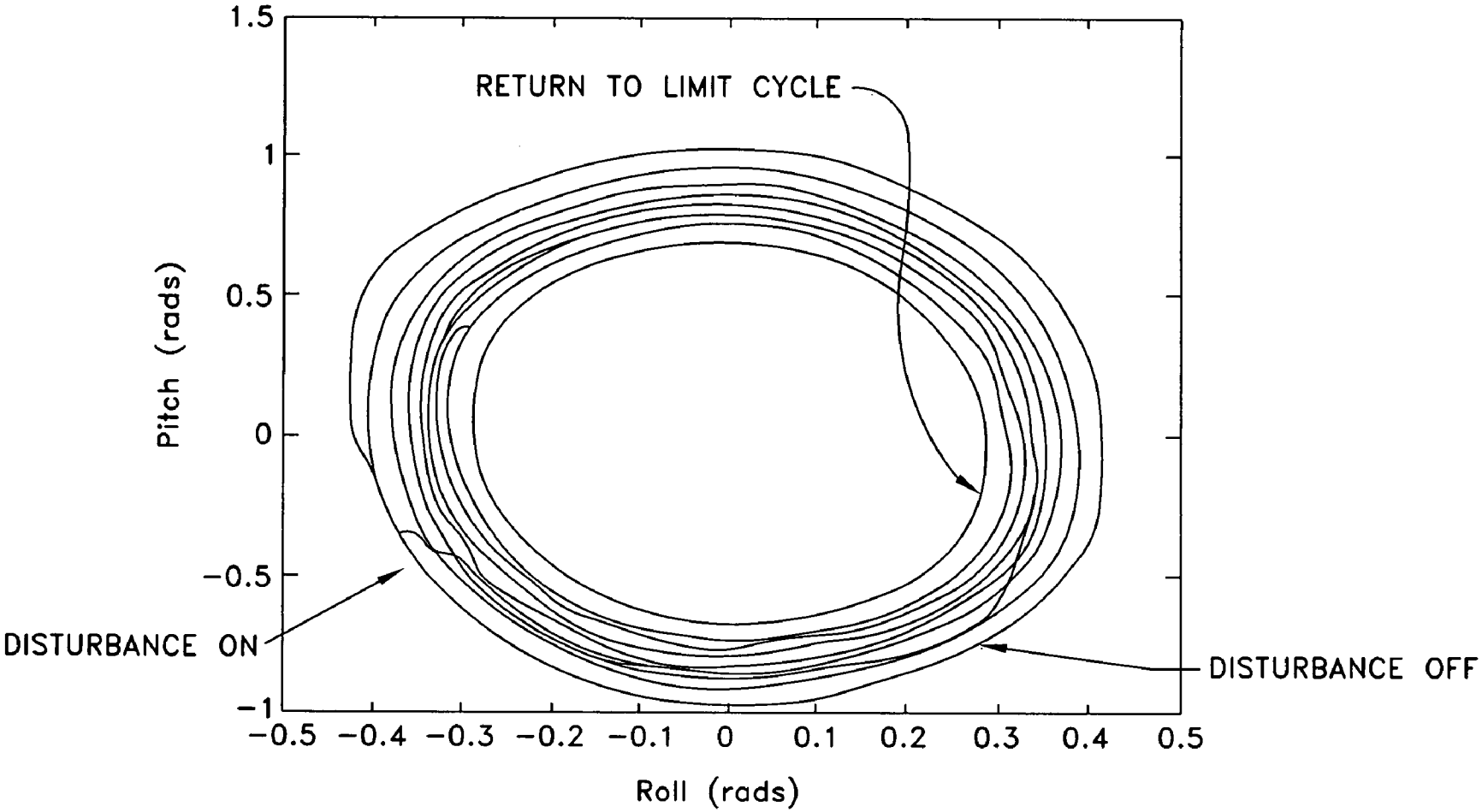
FIG. 23 is a graphical representation of departure and a return to limit cycle following a pulsed disturbance applied to one foil in FIG. 19.

In FIG. 23, a graphical representation of a departure and a return to a limit cycle following a pulsed disturbance is shown. Kinematic oscillation variables, namely foil pitch and roll (=heave in two dimensions) are shown. The two radial lines relate to the ends of the pulsed disturbance.

The advantages of the auto-catalytic oscillator are that the non-linear oscillator generates unique periodic signals x and $\dot{x}$; the periodic signals are stable in that any disturbances introduced are automatically rejected; the amplitude and frequency of the periodic signal can be varied by changing the parameters of the resonator; the phase between the signals can also be varied by changing the parameters of the resonator; the periodic signal can be either sinusoidal or depart fairly significantly from a sinusoid; and the oscillator can be used to restore the foil oscillation parameters after a disturbance is removed without the use of a sensor or involvement of the main controller thereby allowing the foil to be locally autonomous.

The following variations of the described invention may be preferable for some applications.

Implement the non-linear oscillator using one of the forms mentioned in Table 1. For certain applications, non-linearities such as the signum or saturation function may be more suitable.

For certain applications, implement the non-linear oscillator using a higher order system that exhibits a limit cycle.

This oscillator can be used to drive the foils of any underwater vehicle where the maneuvering of the vehicle uses flapping foils. In underwater vehicles where low power consumption and high agility are required at low speeds, this control of the oscillator is particularly attractive. The oscillator can also be used to make the underwater vehicle fault tolerant. For example, if the actuators get caught or are obstructed temporarily, then the oscillators would recover to their preset oscillation parameters once the disturbance is removed.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A system to control motion of flapping foils positioned for maneuvering of an underwater vehicle, said system comprising:

a non-linear oscillator operationally connected to the flapping foils; and a controller operationally connected to said oscillator wherein said controller is capable of resolving the equation $\ddot{x}+f,(x)\dot{x}+\omega^2x=0$ $f(x)=\alpha_0x^2-2\zeta_0\omega$, $\alpha_0,\zeta_0>0$ with $\omega$ representing a frequency of oscillations, f representing a non-linearity, $\ddot{x}$ representing a second derivative and $\zeta$ representing a damping parameter;

wherein said controller is capable of producing a limit cycle with a magnitude, frequency and phase characteristics depending on the parameters $\theta=(\alpha_0,\zeta_0,\omega)$ such that periodic signals are produced to exhibit convergent and divergent behavior for responsive motion control of the flapping foils for maneuvering.

2. The system in accordance with claim 1 where said controller is capable of alternating between the convergent and the divergent behavior thereby leading to a sustained periodic solution as a stable limit cycle by resolving parameters of the equation $\ddot{x}+f(x,\dot{x})\dot{x}+g(x)=0$.

3. The system in accordance with claim 2 wherein said controller is capable of producing an offset in control by altering the non-linearity in the equation $\ddot{x}+f(x,\dot{x})\dot{x}+g(x)=0$ by altering the non-linearity f as $f(x)=\alpha_0x^2-2\zeta_0\omega+\alpha_1x$.

4. The system in accordance with claim 3 wherein the equation $\ddot{x}+f(x,\dot{x})\dot{x}+g(x)=0$ is implemented in analog form.

5. The system in accordance with claim 3 wherein the equation $\ddot{x}+f(x,\dot{x})\dot{x}+g(x)=0$ is implemented in digital form.

6. A system for maneuvering an underwater vehicle with flapping foils, said system comprising:

an auto-catalytic non-linear oscillator, said oscillator capable of producing periodic signals for controlling a pitching and heaving motion of the flapping foils; and a controller, said controller capable of providing a balancing to the underwater vehicle by the phase-coordination of the flapping foils with said oscillator.

7. The system in accordance with claim 6 wherein the motion of the flapping foils is controlled by operating parameters which comprise central commands, obstacle avoidance and adapting/learning that influence operation of said auto-catalytic oscillator.

8. The system in accordance with claim 7 wherein non-linearities for said oscillator are chosen from resolving the equation $$f(x)=\alpha_0x^2-2\zeta_0\omega+\alpha_1x,\ g(x,\dot{x})=\omega^2x.$$

9. The system in accordance with claim 8 wherein signals x and $\dot{x}$ are generated for the produced periodic signals.

10. The system in accordance with claim 9 said system further comprising a resonator operationally connected to said controller wherein the amplitude and frequency of the periodic signal can be varied by changing parameters of said resonator.

11. The system in accordance with claim 10 wherein the phase between the produced periodic signals can be varied by changing the parameters of said resonator.

* * * * *